US011305279B2

(12) United States Patent
Solomon

(10) Patent No.: US 11,305,279 B2
(45) Date of Patent: Apr. 19, 2022

(54) INTEGRATED FLUIDIC CIRCUIT AND DEVICE FOR DROPLET MANIPULATION AND METHODS THEREOF

(71) Applicant: NEOFLUIDICS, LLC, San Diego, CA (US)

(72) Inventor: Deepak Solomon, San Diego, CA (US)

( * ) Notice: Subject to any disclaimer, the term of this patent is extended or adjusted under 35 U.S.C. 154(b) by 166 days.

(21) Appl. No.: 16/762,827

(22) PCT Filed: Nov. 9, 2018

(86) PCT No.: PCT/US2018/060104

§ 371 (c)(1),
(2) Date: May 8, 2020

(87) PCT Pub. No.: WO2019/094775

PCT Pub. Date: May 16, 2019

(65) Prior Publication Data

US 2020/0261910 A1 Aug. 20, 2020

Related U.S. Application Data

(60) Provisional application No. 62/584,710, filed on Nov. 10, 2017.

(51) Int. Cl.
*B01L 3/00* (2006.01)

(52) U.S. Cl.
CPC ..... *B01L 3/502738* (2013.01); *B01L 3/50273* (2013.01); *B01L 2200/0605* (2013.01);
(Continued)

(58) Field of Classification Search
CPC ..... B01L 2200/0605; B01L 2200/0621; B01L 2300/0816; B01L 2300/0867;
(Continued)

(56) References Cited

U.S. PATENT DOCUMENTS

2002/0097633 A1 7/2002 O'Connor et al.
2004/0072278 A1* 4/2004 Chou ..... G01N 15/1456 435/29

(Continued)

OTHER PUBLICATIONS

International Application No. PCT/US2018/060104, International Search Report dated Feb. 28, 2019, 14 pages.

(Continued)

*Primary Examiner* — Jennifer Wecker
*Assistant Examiner* — Jonathan Bortoli
(74) *Attorney, Agent, or Firm* — Cooley LLP

(57) ABSTRACT

Various embodiments of fluidic devices and methods of the present teaching can provide precision on-device loading of fluidic samples, and merging, mixing, and splitting of the fluidic samples, in illustrative embodiments as droplets, using pressures that can be provided by standard laboratory liquid handling equipment. Various embodiments of fluidic devices of the present teachings can provide on-device manipulation of accurate and precise fluidic volumes at the picoliter to nanoliter scale for each steps from fluidic sample loading to fluidic sample splitting. Various embodiments of fluidic elements of the present teachings, for example, but not limited by, various embodiments of fluidic traps of the present teachings, can have a constrained and measurable geometry, allowing for accurate and precise tuning of each fluidic sample volume throughout the on-device liquid handling process.

20 Claims, 18 Drawing Sheets

(52) U.S. Cl.
CPC ..... *B01L 2200/0621* (2013.01); *B01L 2300/0867* (2013.01); *B01L 2300/0883* (2013.01); *B01L 2300/165* (2013.01); *B01L 2400/0487* (2013.01)

(58) Field of Classification Search
CPC ..... B01L 2300/0883; B01L 2300/165; B01L 2400/0406; B01L 2400/0487; B01L 2400/0688; B01L 3/50273; B01L 3/502738
See application file for complete search history.

(56) References Cited

U.S. PATENT DOCUMENTS

| | | | | |
|---|---|---|---|---|
| 2007/0110631 | A1 | 5/2007 | Ajdari et al. | |
| 2012/0219947 | A1 | 8/2012 | Yurkovetsky et al. | |
| 2016/0361716 | A1* | 12/2016 | Solomon ..... | B01L 3/50273 |

OTHER PUBLICATIONS

Clausell-Tormos, et al., "An Automated Two-phase Microfluidic System for Kinetic Analyses and the Screening of Compound Libraries," Lab on a Chip, 2010, Issue 10, pp. 1302-1307.

* cited by examiner

INTEGRATED FLUIDIC CIRCUIT AND DEVICE FOR DROPLET MANIPULATION AND METHODS THEREOF

RELATED APPLICATIONS

This application claims the benefit of U.S. Ser. No. 62/584,710 entitled "INTERGRATED FLUIDIC CIRCUIT AND DEVICE FOR DROPLET MANIPULATION AND METHODS THEREOF" filed on Nov. 10, 2017, which is incorporated herein by reference in its entirety.

FIELD OF THE DISCLOSURE

This disclosure is generally related to fluidics devices and methods for fluid handling, performing a bioassay, or sample processing using fluidic devices.

BACKGROUND

Technology advances offering ease of droplet manipulation for precise and measurable volumes at the picoliter to nanoliter scale can provide enhanced utility for a variety of analysis platforms, for example, biological assays platforms and pharmaceutical testing platforms. For example, some exemplary benefits of precise and measurable droplet manipulation at such scales include reduction in reagent and sample volume, as well as shorter analysis times, thereby providing the potential for increased throughput. In that regard, technology for droplet manipulation at the picoliter to nanoliter scale that can be readily integrated into automated systems affords the ability to do large scale multiplexing that can be used for high-throughput applications such as screening of candidate pharmaceutical substances, and library preparation for next-generation sequencing. Thus, such technologies can help to facilitate the discovery of important new drugs to treat human diseases and the development of important new diagnostic tests to help to detect, prognose and monitor human diseases.

Various current approaches for achieving on-device coalescence and splitting of droplets at the picoliter to nanoliter scale can require system complexity to integrate an electrical, magnetic or acoustic source to apply a driving force to achieve on-device liquid handling. Still other various current approaches for liquid handling of droplets at that scale that can be adaptable to high-throughput analysis platforms can utilize an immiscible fluid plug to separate various liquids on-device. Such approaches can require precise liquid handling systems, can present a challenge to find an immiscible fluid that provides effective separation of droplets, and can increase the complexity of fluid handling with the additional need for fluid handling of the liquid or gas, or combination thereof, selected to provide the separation plug.

Given the impact of precision liquid handling at nanoliter scale on reliable analysis, there is a need in the art for precision liquid handling that minimizes liquid cross-contamination, is adaptable to high-throughput analyses, and provides consistent analytical results. Various embodiments of fluidic devices and methods of the present teaching can provide precision on-device liquid handling including loading, merging, mixing, and splitting of droplets using pressures that can be provided by standard laboratory liquid handling equipment.

SUMMARY OF THE DISCLOSURE

Illustrative aspects of the present teachings are effective for liquid handling, for example precision liquid handle at nanoliter scale, and alleviate the need for oil as the second phase immiscible fluid in passive droplet coalescence and fission of such coalesced droplets, thus mitigating possible contamination from the oil itself, as well as reducing the complexity, time, and resources needed during passive droplet coalescence and fission. Illustrative aspects of fluidic components, circuits and devices provided herein, are capable of merging two picoliter and/or nanoliter scale droplets without the use of external electrical, magnetic, or acoustic-driven forces, in a controlled and contaminant free environment. Furthermore, passive fluidic valves which are included in illustrative embodiments, reduce the complexity of introducing an external valve for proper control and manipulation of droplets.

In illustrative aspects, provided herein is a fluidic circuit, or a fluidic component or a fluidic device comprising the same, or a method of using the fluidic circuit, fluidic component, or fluidic device, that is effective for manipulating droplets (e.g. loading, merging, mixing, and/or splitting of droplets, and various combinations thereof). In illustrative embodiments, a fluidic component, a fluidic circuit, or a fluidic device comprising the same or a method of using the same, is effective and/or adapted for fusing a portion of a first liquid sample and a portion of a second liquid sample into a coalescent sample, in illustrative embodiments as a coalesced droplet. Furthermore, in certain embodiments, a fluidic circuit, a fluidic component, fluidic device, or a method of using the same is effective and/or adapted for mixing the coalescent sample (e.g. coalesced droplet) and/or effective and/or adapted for separating the coalescent sample (e.g. coalesced droplet) into a plurality of sub-aliquots.

Other aspects and embodiments are also contemplated, as will be understood by those of ordinary skill in the art from this disclosure.

BRIEF DESCRIPTION OF THE DRAWINGS

A better understanding of the features and advantages of the present disclosure will be obtained by reference to the accompanying drawings, which are intended to illustrate, not limit, the present teachings.

DETAILED DESCRIPTION OF THE DISCLOSURE

Various embodiments of components, devices and methods of the present teaching can provide precision on-device loading, merging, mixing, and splitting of droplets using pressures that can be externally actuated by standard laboratory liquid handling equipment. Various embodiments of fluidic devices of the present teachings can provide on-device manipulation of accurate and precise droplet volumes at the picoliter to nanoliter scale for each step from droplet loading to droplet splitting. Various embodiments of fluidic elements of the present teachings, for example, but not limited by, various embodiments of fluidic traps of the present teachings, can have a constrained and measurable geometry, allowing for accurate and precise tuning of each droplet volume throughout the on-device liquid handling process.

According to the present teachings, on-device liquid handling can be externally actuated in manual or automated mode using any manual or automated standard laboratory liquid handling equipment, such as manual or automated pipetting systems utilizing solid or liquid displacement, that can provide a pressure from between about 720 torr to about 800 torr, which is about +/−40 torr from 1 standard atmosphere of pressure. As will be disclosed in more detail herein, according to various embodiments of components, devices and methods of the present teachings, a pressure applied at a port or between ports can be used as a motive force for moving liquids, for example, from one branch of a fluidic circuit to another branch of a fluidic circuit. According to the present teachings, a motive force for on-device liquid handling can be externally actuated by applying a decreased or negative pressure at a port or between ports or by applying an increased or a positive pressure at a port or between ports.

Figure 1:
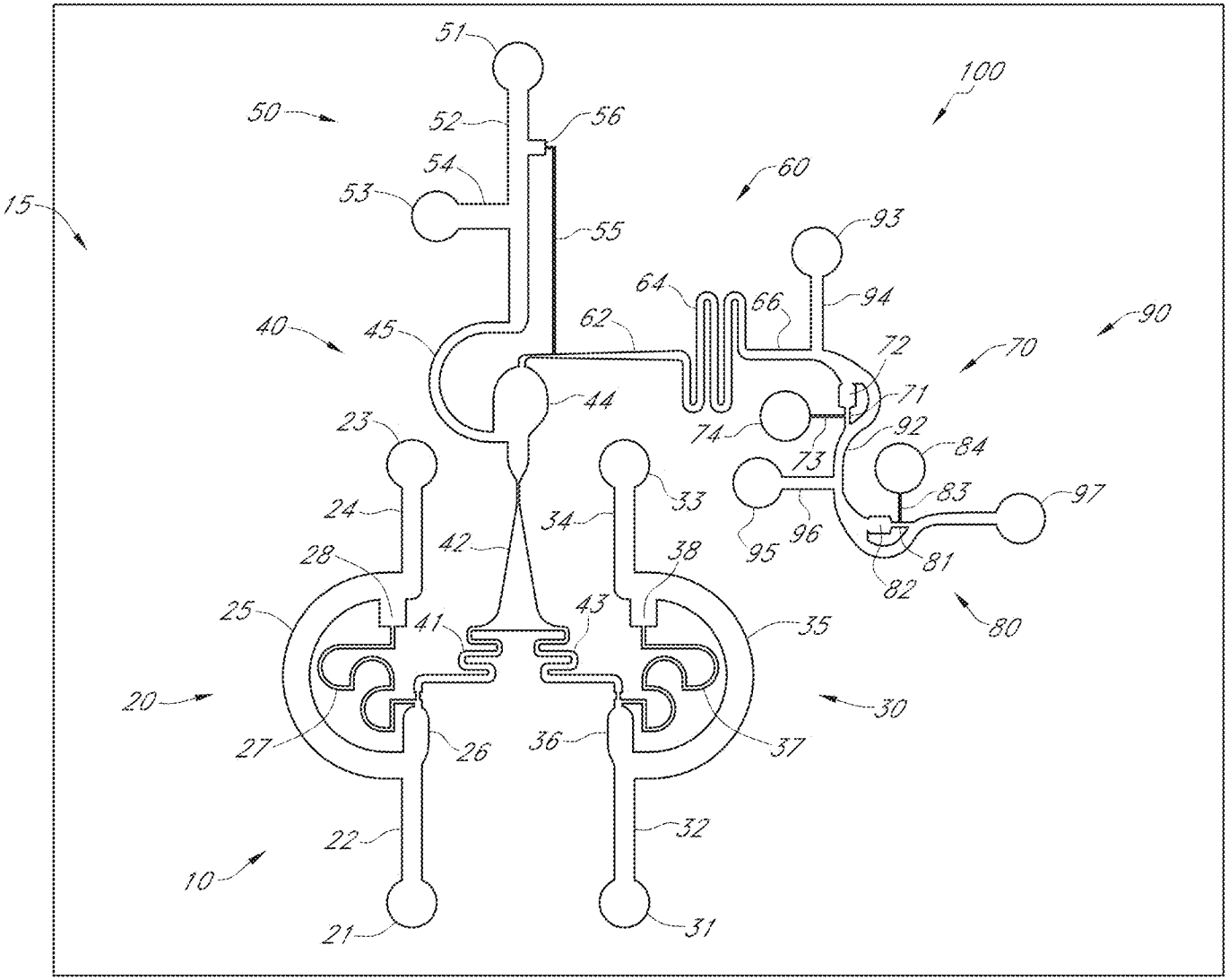
FIG. 1 is a schematic top view of a fluidic circuit of the present teachings.

FIG. 1 depicts an exemplary fluidic circuit 100 according to various embodiments of components, devices and methods of the present teachings, which can be formed in a number of different materials with a variety of fabrication processes. As will be disclosed in more detail herein, various embodiments of a fluidic circuit of FIG. 1 can provide on-device liquid handling of droplets, providing ease of droplet manipulation required for a variety of sample preparation methods, as well for a variety of analytical methods. As used herein unless otherwise specified, a sample can be any liquid that can be loaded onto a device, such as a device utilizing embodiments of a component of the present teachings, such as fluidic circuit 100 of FIG. 1. Some exemplary sample liquids can be a test sample for target analysis, a reagent used in an analysis, including sample preparation, for example, a buffer, a diluent, or a reagent used to adjust analysis conditions, such as ionic strength or pH, as well as any sample liquid used for analysis, for example, any reagent used for detection. Exemplary test samples can include a cell culture sample as well as a tissue sample, a tumor sample, or a blood (or any fraction thereof such as sera or plasma) sample from a subject.

Fluidic circuit 100 of FIG. 1 can have sample capture branch 10 that can have at least two sample capture sections; two of which are depicted in FIG. 1 as first sample capture section 20 and second sample capture section 30. Various embodiments of components, devices and methods of the present teachings can utilize additional sample capture sections, for example, from 1 to about 10 additional sample capture sections.

Figure 2:
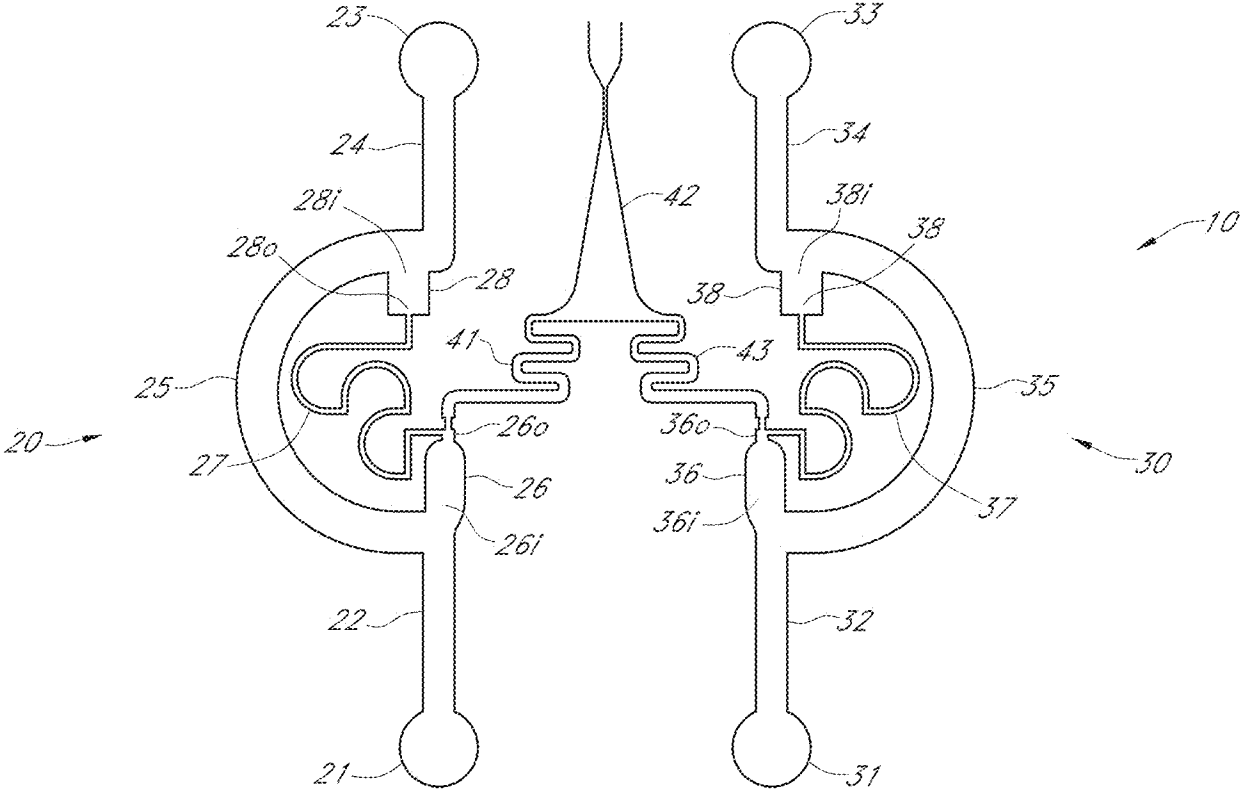
FIG. 2 is an expanded top schematic view of a sample capture branch of a fluidic circuit of the present teachings.

First sample capture section 20 of FIG. 1 and FIG. 2 can have sample capture trap 26 with outlet end $\mathbf{26}_o$ in flow communication with outlet end $\mathbf{28}_o$ of sample capture valve 28 via sample capture constriction channel 27. In addition to sample capture trap 26 and sample capture valve 28, sample capture section can have sample filling bypass channel 25 that can have a first end in flow communication with inlet end $\mathbf{26}_i$ of sample capture trap 26 and a second end in flow communication with inlet end $\mathbf{28}_i$ of the sample capture valve 28. With respect to sample loading of first sample capture section 20, first sample filling chamber 21 can be in flow communication with the first end of bypass channel 25 via first sample filling channel 22. Additionally, first sample capture section 20 can have second sample filling chamber 23, which can be in flow communication with the second end of bypass channel 25 via second filling channel 24.

In an analogous fashion, second sample capture section 30 of FIG. 1 and FIG. 2 can have sample capture trap 36 with outlet end $\mathbf{36}_o$ in flow communication with outlet end $\mathbf{38}_o$ of sample capture valve 38 via sample capture constriction channel 37. In addition to sample capture trap 36 and sample capture valve 38, second sample capture section 30 can have sample filling bypass channel 35 that can have a first end in flow communication with inlet end $\mathbf{36}_i$ of sample capture trap 36 and a second end in flow communication with inlet end $\mathbf{38}_i$ of the sample capture valve 38. With respect to sample loading of second sample capture section 30, first sample filling chamber 31 can be in flow communication with the first end of bypass channel 35 via first sample filling channel 32. Additionally, second sample capture section 30 can have second sample filling chamber 33, which can be in flow communication with the second end of bypass channel 35 via second filling channel 34.

As will be disclosed in more detail herein, sample capture valve 28 of first sample capture section 20 and sample capture valve 38 of second sample capture section 30 can assist in the process of sample droplet transfer from sample capture trap 26 to sample convergent channel 41 and sample capture trap 36 to sample convergent channel 43, respectively. As will be additionally disclosed in more detail herein, it should be noted that in a loading step for loading a sample in sample capture trap 26 of first sample capture section 20 or loading a sample in sample capture trap 36 of second sample capture section 30, that sample capture valve 28 of first sample capture section 20 and sample capture valve 38 of second sample capture section 30 are also loaded or primed.

Fluidic circuit 100 of FIG. 1 can have sample coalescence branch 40 in flow communication with sample capture branch 10. As depicted in FIG. 2, first sample convergent channel 41 can be in flow communication with outlet end $\mathbf{26}_o$ of sample capture trap 26 of first sample capture section 20, while second sample convergent channel 43 can be in flow communication with outlet end $36_o$ of sample capture trap 36 of second sample capture section 30. First sample convergent channel 41 and second sample convergent channel 43 can be in flow communication with sample convergent inlet chamber 42. Sample convergent inlet chamber 42 is in flow communication with sample coalescence trap 44.

As depicted in FIG. 1, in addition to sample capture branch 10 and sample coalescence branch 40, various embodiments of components, devices and methods of the present teachings can have flow control branch 50 that can be in flow communication with sample coalescence branch 40 and sample sub-aliquoting branch 90. As will be disclosed in more detail herein, a flow control branch, such as flow control branch 50 of FIG. 1, can be utilized in both the process of transferring samples from each of a sample capture section into a sample coalescence trap of a sample coalescence branch, as well as transferring a coalescent sample into each fission trap in a sample sub-aliquoting branch.

Flow control branch 50 of FIG. 1 can include flow control bypass channel 45, which is flow communication with sample coalescence trap 44. In various embodiments of components, devices and methods of the preset teachings, flow control primary channel 52 can be in flow communication with flow control primary channel chamber 51, as well as flow control secondary channel 54. As depicted in FIG. 1, flow control secondary channel 54 can be in flow communication with flow control secondary channel chamber 53. Flow control branch 50 of FIG. 1 can include flow control valve 56, which is in flow communication with flow control primary channel 52 and with a flow control valve constriction channel 55. Flow control valve 56 and flow control valve constriction channel 55 can provide fluidic resistance in the process of transferring a coalescent sample into a sample sub-aliquoting branch, where the coalescent sample can be sub-aliquoted into defined volumes.

Figure 5:
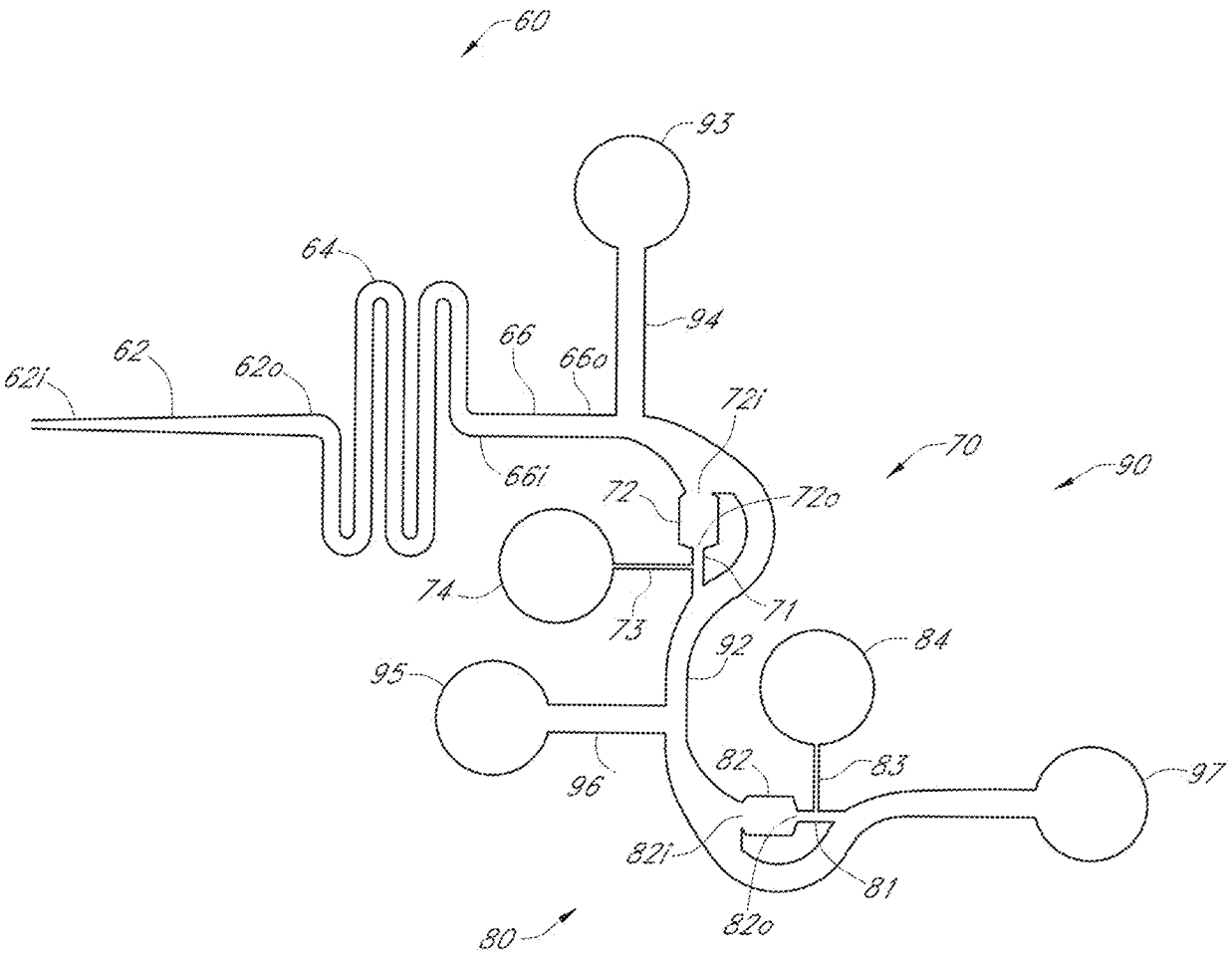
FIG. 5 is an expanded top schematic view of a sample mixing channel and a sample sub-aliquoting branch of a fluidic circuit of the present teachings.

In that regard, in various embodiments of components, devices and methods of the present teachings, sample sub-aliquoting branch 90 of FIG. 1 can be in flow communication with flow control valve 56 and flow control valve constriction channel 55 via sample sub-aliquoting channel 92. Sample sub-aliquoting branch 90 can have at least two fission trap sections; depicted in FIG. 1 as first fission trap section 70 and second fission trap section 80. As depicted in FIG. 5, first fission trap section can have sample fission trap 72 with inlet end $72_i$ in flow communication with sample sub-aliquoting channel 92. Sample fission trap 72 of first fission trap section 70 can have outlet end $72_o$ in flow communication with sample fission trap constriction channel 71. Sample fission trap outlet chamber 74 of first fission trap section 70 can be in flow communication with fission trap constriction channel 71 through sample fission trap outlet chamber constriction channel 73. In an analogous fashion, second fission trap section 80 as depicted in FIG. 5, can have sample fission trap 82 with inlet end $82_i$ in flow communication with sample sub-aliquoting channel 92. Sample fission trap 82 of second fission trap section 80 can have outlet end $82_o$ in flow communication with sample fission trap constriction channel 81. Sample fission trap outlet chamber 84 of second fission trap section 80 can be in flow communication with fission trap constriction channel 81 through sample fission trap outlet chamber constriction channel 83.

As will be disclosed in more detail subsequently herein, each of sample capture trap 26 of first sample capture section 20, sample capture trap 36 of second sample capture section 30, sample coalescence trap 44 of sample coalescence branch 40, sample fission trap 72 of first fission trap section 70 and sample fission trap 82 of second fission trap section 80, can have a measurable geometry providing a defined sample volume of known accuracy and precision. Such measurable geometry providing a defined sample volume of known accuracy and precision can be at least in part a function of the materials and processes used to fabricate various components and devices of the present teachings. Additionally, various embodiments of components, devices and methods of the present teachings can have other fluidic features than those previously disclosed. The sample capture traps in exemplary embodiments can hold between 1 picoliter (pl) and 100 microliters (ul), or between 1 pl and 1 ul, or between 10 pl and 1 ul, or between 10 pl and 100 nanoliters (nl), or between 100 pl and 100 nl, or between 1 nl and 1 ul, or between 1 nl and 100 nl, or between 10 nl and 1 ul, or between 10 nl and 250 nl, or between 10 nl and 100 nl. Thus, in methods provided herein, these volumes can be loaded into the sample capture trap. The sample coalescence trap in exemplary embodiments can hold between 2 and 10 times, or between 2 and 5 times the volume of the sample capture trap. The sample coalescence trap in exemplary embodiments can hold between 1 picoliter (pl) and 250 microliters (ul), or between 2 pl and 200 ul, or between 2 pl and 2 ul, or between 20 pl and 2 ul, or between 20 pl and 200 nl, or between 200 pl and 200 nl, or between 2 nl and 2 ul, or between 2 nl and 200 nl, or between 20 nl and 2 ul, or between 20 nl and 500 nl, or between 20 nl and 200 nl. The sample fission traps in exemplary embodiments can hold between ½ and 1/100, or between ½ and 1/20, or between ½ and 1/10, or between ½ and ⅕, or between ⅕ and 1/20, the volume of the sample capture trap. The sample coalescence trap in exemplary embodiments can hold between 1 picoliter (pl) and 100 microliters (ul), or between 1 pl and 1 ul, or between 2 pl and 50 ul, or between 10 pl and 1 ul, or between 10 pl and 100 nl, or between 100 pl and 100 nl, or between 1 nl and 1 ul, or between 1 nl and 100 nl, or between 10 nl and 1 ul, or between 10 nl and 50 nl, or between 10 nl and 100 nl.

For example, fluidic circuit 100 of FIG. 1 is depicted with mixing channel 60 in flow communication with sample coalescence branch 40 and flow control valve constriction channel 55 at an inlet end, and sample sub-aliquoting channel 92 at an outlet end. For some embodiments of components, devices and methods of the present teachings, sample mixing can be effectively done in the transferring of samples into a sample coalescence trap and into a sample sub-aliquoting branch, where a coalesced sample is split into aliquots in at least two fission traps. In alternative embodiments of components, devices and methods of the present teachings, sample mixing can be performed by flowing a coalesced sample through a mixing channel before it is split into aliquots in at least two fission traps.

In that regard, for various embodiments of a fluidic circuit of the present teachings, various combinations of a fluidic branch, such as sample capture branch 10, sample coalescence branch 40, flow control branch 50, sample mixing channel 60 and sample sub-aliquoting branch 90 can be fabricated in a substrate. For example, various embodiments of a fluidic circuit can provide for sample loading and coalescence with a fluidic circuit including sample capture branch 10, sample coalescence branch 40, and flow control branch 50. Various other exemplary embodiments of a fluidic circuit can provide for sample sub-aliquoting with a fluidic circuit including sample coalescence branch 40, flow control branch 50 and sample sub-aliquoting branch 90. Further, various exemplary embodiments of a fluidic circuit can provide for sample coalescence and sample mixing with a fluidic circuit including sample capture branch 10, sample coalescence branch 40, flow control branch 50 and sample mixing channel 60. Accordingly, various embodiments of components, devices and methods of the present teaching can provide precision on-device liquid handling that can include loading, merging, mixing, and splitting of fluids, which in illustrative embodiments are droplets, and various combinations thereof.

FIG. 2 depicts an expanded top schematic view of a sample capture branch of a fluidic circuit of the present teachings, such as fluidic circuit 100 of FIG. 1. As previously disclosed herein, sample capture valve 28 of first sample capture section 20 and sample capture valve 38 of second sample capture section 30 can assist in the process of fluidic sample (e.g. droplet) transfer from sample capture trap 26 of first sample capture section 20 to first sample convergent channel 41 and from sample capture trap 36 of second sample capture section 30 to second sample convergent channel 43, respectively. Sample capture valve 28 of first sample capture section 20 can be in flow communication with sample capture constriction channel 27. Similarly, sample capture valve 38 of second sample capture section 30 can be in flow communication with sample capture constriction channel 37.

According to the present teachings, the combination of a sample capture valve and a constriction channel can assist in providing a uniform low pressure at the outlet ends of each sample trap, such as outlet end of $\mathbf{26}_o$ of sample capture trap 26 of first sample capture section 20, and outlet end of $\mathbf{36}_o$ of sample capture trap 36 of second sample capture section 30. Providing a uniform low pressure at the outlet ends of each sample trap can assist in enabling a simultaneous transfer of each sample loaded into a sample trap to a sample coalescence trap. Further, the fluidic resistance provided by a valve that has been loaded or primed, such as sample capture valve 28 of first sample capture section 20 and sample capture valve 38 of second sample capture section 30, can be adjusted by a defined volume of the sample capture valve as a ratio to a defined volume of the sample capture trap. Additionally, in conjunction with the fluidic resistance provided by a sample capture trap that has been primed, fluidic resistance is also provided by a sample capture constriction channel, such as sample capture constriction channel 27 of first sample capture section 20 and sample capture constriction channel 37 of second sample capture section 30. The fluidic resistance of a sample capture constriction channel, such as sample capture constriction channel 27 of first sample capture section 20 and sample capture constriction channel 37 of second sample capture section 30 can be adjusted by adjusting the dimensions of the channel.

For example, in an exemplary sample capture section, such as first sample capture section 20 or second sample capture section 30 of FIG. 1, for fluidic features formed at a constant height of 180μ (micron), a sample capture trap can be about 520μ (micron) wide and about 1 mm long, while a sample capture valve can be about 520μ (micron) wide and about 520μ (micron) long. As such, for an exemplary sample capture section, the ratio of the sample capture trap volume to the sample capture valve volume can be about 2:1. In such an exemplary sample capture section, a sample capture constriction channel can be about 80μ (micron) wide and about 7 mm long. In various embodiments of components, devices and methods of the present teachings, the ratio of a sample capture trap volume to a sample capture valve volume can range from about 5:1 at an upper limit to about 1:1 at a lower limit. In various embodiments of components, devices and methods of the present teachings, a sample capture constriction channel can be between about 15μ (micron) to about and 100μ (micron) wide and between about 2 mm to about 10 mm long. In principle, any variation in the dimensions of a sample capture trap, a sample capture valve and sample capture constriction channel that provide a fluidic resistance given by the exemplary sample capture section should function according to various embodiments of components, devices and methods of the present teaching. It should be noted that the dynamic viscosity range of liquids that can be processed in various embodiments of components, devices and methods of the present teachings can range from between about $1.0\times10^{-3}$ Pas s to about $6.0\times10^{-3}$ Pas sec at 20° C.

A sample capture trap, such as sample capture trap 26 of first sample capture section 20 and sample capture trap 36 of second sample capture section 30 of FIG. 2, can be in flow communication with a sample filling bypass channel. First sample filling bypass channel 25 and second sample filling bypass channel 35 can be 420μ (micron) to about 620μ (micron) in width and between about 5 mm to about 7 mm in length. A sample filling bypass channel can be in flow communication with a first sample filling channel and a second sample filling channel, such as first sample filling channel 22 and second filling channel 24 of first sample capture section 20, and first sample filling channel 32 and second filling channel 34 of second sample capture section 30, which can be 320μ (micron) to about 480μ (micron) in width and between about 1.8 mm to about 2.7 mm in length. Each sample filling channel can be in flow communication with a sample filling chamber, such as first sample filling chamber 21 and second filling chamber 23 of first sample capture section 20, and second sample filling chamber 31 and second filling chamber 33 of second sample capture section 30, which can have a diameter of between about 500μ (micron) to about 1 mm, for example.

According to various embodiments of components, devices and methods of the present teachings, the tolerance on the accuracy and precision of the geometry of fluidic features of a sample capture branch of the present teachings can be within 10%, and in illustrative embodiments within 5%.

Figure 3:
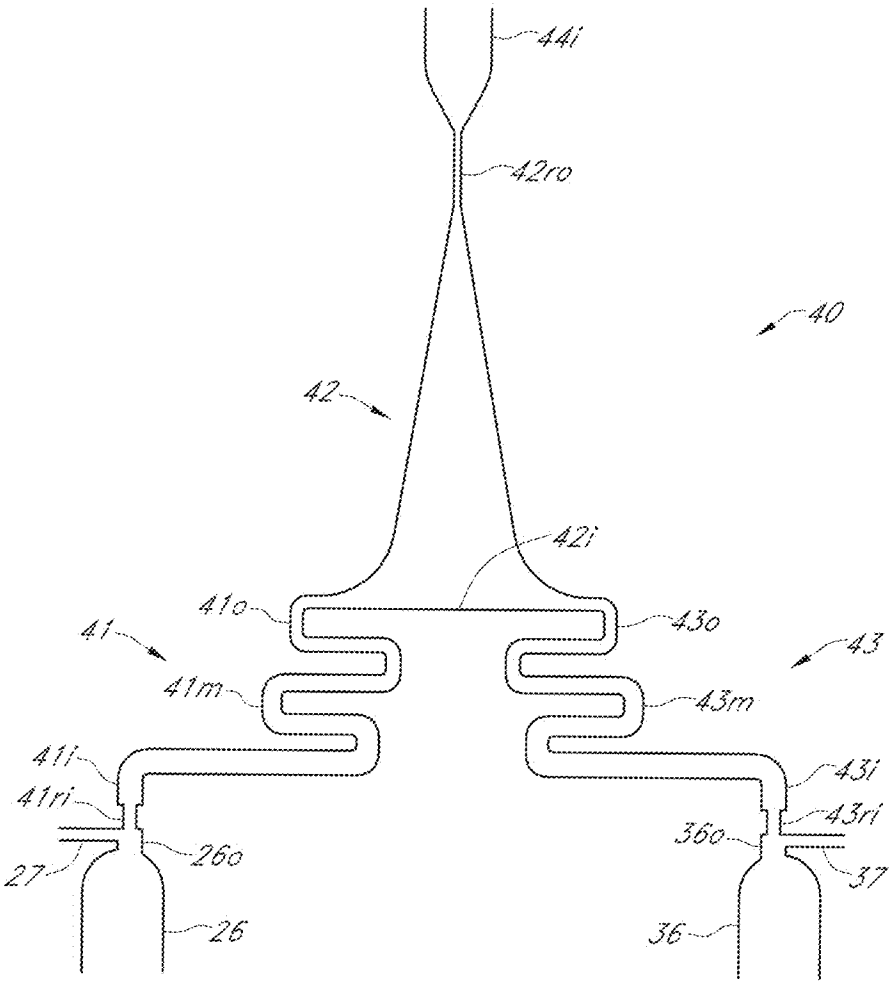
FIG. 3 is an expanded top schematic view of a sample coalescence branch of a fluidic circuit of the present teachings.

FIG. 3 depicts an expanded top schematic view of a sample coalescence branch 40 of a fluidic circuit of the present teachings, such as fluidic circuit 100 of FIG. 1. As depicted in FIG. 3, first sample convergent channel 41 is in flow communication with outlet end $\mathbf{26}_o$ of sample capture trap 26 of first sample capture section 20, and second sample convergent channel 43 is in flow communication with outlet end $\mathbf{36}_o$ of sample capture trap 36 of first sample capture section 30. At the inlet end of first sample convergent channel 41 is first sample convergent channel inlet constriction section $\mathbf{41}_{ri}$ and the first sample convergent channel inlet section $\mathbf{41}_i$, followed by first sample convergent channel middle section $\mathbf{41}_m$ and then first sample convergent channel outlet section $\mathbf{41}_o$. Similarly, at the inlet end of second sample convergent channel 43 is second sample convergent channel inlet constriction section $\mathbf{43}_{ri}$ and then second sample convergent channel inlet section $\mathbf{43}_i$, followed by second sample convergent channel middle section $\mathbf{43}_m$ and then second sample convergent channel outlet section $\mathbf{43}_o$. Each convergent channel can be in flow communication with sample convergent inlet chamber 42. Sample convergent inlet chamber 42 can have sample convergent inlet chamber inlet end $\mathbf{42}_i$ and sample convergent inlet chamber outlet constriction channel $\mathbf{42}_{ro}$. at an outlet end of a sample convergent inlet chamber. In illustrative embodiments, as depicted in FIG. 3, sample convergent channels can have between 1 and 12, or in illustrative embodiments between 2 and 6 bends, loops or turns.

According to the present teachings, sample coalescence branch 40 can provide nearly synchronized, synchronized, nearly simultaneous, or simultaneous transfer of each sample in a sample capture trap to a sample coalescence trap, such as sample coalescence trap 44 of FIG. 3. First sample convergent channel inlet constriction section $\mathbf{41}_{ri}$ and second sample convergent channel inlet constriction section $\mathbf{43}_{ri}$ can provide an initial fluidic resistance for samples loaded in each sample trap. First sample convergent channel inlet constriction section $\mathbf{41}_{ri}$ and second sample convergent channel inlet constriction section $\mathbf{43}_{ri}$ can be between 50μ (micron) to about 150μ (micron) and in illustrative embodiments between 65μ (micron) to about 100μ or 95μ (micron) in width and between about 100μ (micron) to about 250μ (micron) and in illustrative embodiments between 120μ (micron) to 180μ (micron) in length, with the length typically larger than the width, while the overall length of a sample convergent channel can be between about 2.5 to about 10 mm, or in illustrative embodiments between 4.5 mm to 5.5 mm. Additionally, a sample convergent channel can taper in width from between about 100μ (micron) to about 200μ (micron) and in illustrative embodiments between 130μμ (micron) to 160μ (micron) at a sample convergent channel inlet section, to between about 50μ (micron) to about 150μ (micron) and in illustrative embodiments between 95μ (micron) to 145μ (micron) at a sample convergent channel middle section, and finally, to between about 25μ (micron) to about 125μ (micron) and in illustrative embodiments between 65μ (micron) to 95μ (micron) at a sample convergent channel outlet section. Such tapering of a sample convergent channel can provide for the simultaneous transfer of each sample from a sample capture trap through a sample convergent channel, as well as provide for the uniform filling of a sample convergent inlet chamber; particularly as each sample enters a sample convergent inlet chamber at an inlet end, such as sample convergent inlet chamber inlet end $\mathbf{42}_i$ of FIG. 3.

Sample convergent inlet chamber 42 can have a width of between about 500μ (micron) to about 1.5 mm and in illustrative embodiments between 800μ (micron) to 1.2 mm at its base at sample convergent inlet chamber inlet end $\mathbf{42}_i$ to a width of between about 25μ (micron) to about 75μ (micron) and in illustrative embodiments between 30μ (micron) to 50μ (micron) at the narrowest portion of convergent inlet chamber inlet $\mathbf{42}_i$. Similarly, outlet constriction channel $\mathbf{42}_{ro}$, which is in flow communication with the narrowest portion of convergent inlet chamber inlet $\mathbf{42}_i$, can have a width of between about 25μ (micron) to about 75μ (micron) and in illustrative embodiments between 30μ (micron) to 50μ (micron) and a length of between about 400μ (micron) to about 600μ (micron), or between about 425μ (micron) to about 500μ (micron), and in illustrative embodiments between 450μ (micron) to 470μ (micron). The overall height of a sample convergent inlet chamber 42 can be between about 1 mm and 5 mm, and in illustrative embodiments can be between 2.5 mm to 3.5 mm; of which a sample convergent inlet chamber outlet constriction channel can be between about 250μ (micron) to about 750μ (micron) and in illustrative embodiments between 350μ (micron) to 550μ (micron) in length. The tolerance on the geometry of fluidic features of FIG. 3 of the present teachings can be within 10% or in illustrative embodiments, within 5%.

Figure 4:
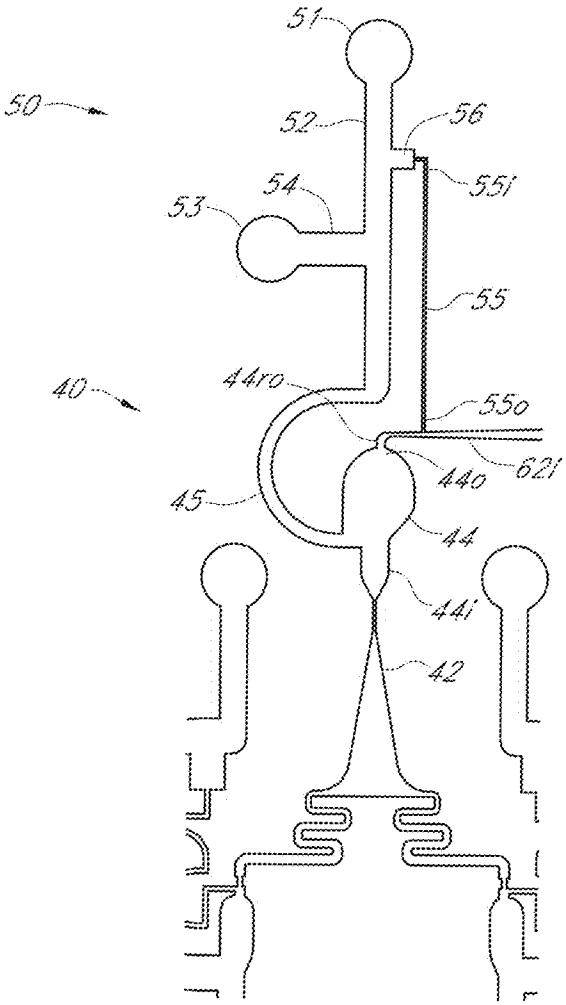
FIG. 4 is an expanded top schematic view of a sample coalescence branch and a flow control branch of a fluidic circuit of the present teachings.

FIG. 4 depicts an expanded top schematic view of a sample coalescence branch and a flow control branch of a fluidic circuit of the present teachings. According to the present teachings, a flow control branch can be used in a process of transferring each sample of a sample capture branch to a coalescence trap and can be used in a process of transferring a coalescent sample to a sample sub-aliquoting branch.

As depicted in FIG. 4, sample coalescence trap 44 can have a funnel-shaped sample coalescence trap inlet end $\mathbf{44}_i$ and a sample coalescence trap constriction channel $\mathbf{44}_{ro}$ at sample coalescence trap outlet end $\mathbf{44}_o$. Sample coalescence trap outlet end $\mathbf{44}_o$ can be in flow communication with first sample mixing channel section inlet end $\mathbf{62}_i$ (see also FIG. 5). For various embodiments of components, devices and methods of the present teachings that do not utilize a mixing channel, sample coalescence trap outlet end $\mathbf{44}_o$ can be in flow communication with a sample sub-aliquoting channel. At the wideset portion, sample coalescence trap inlet end $\mathbf{44}_i$ can have a width of be between about 250μ (micron) to about 600μ (micron) and in illustrative embodiments between 320μ (micron) to 480μ (micron) and can taper at the funnel portion to the width of sample convergent inlet chamber outlet constriction channel $\mathbf{42}_{ro}$, which is a width of between about 10μ (micron) to about 75μ (micron) or in illustrative embodiments between 30μ (micron) to 50μ (micron). The length of funnel-shaped sample coalescence trap inlet end $\mathbf{44}_i$ can be between about 0.5 mm to about 2.0 mm, or between 1.0 and 1.5 mm, and in illustrative embodiments between 1.1 mm to 1.2 mm. Sample coalescence trap 44 can have can have a width of between about 500μ (micron) to about 2 mm and in illustrative embodiments between 800μ (micron) to about 1.2 mm and a length of between about 0.75 mm to about 2.0 mm and in illustrative embodiments between 1.1 mm to 1.5 mm. Sample coalescence trap inlet end $\mathbf{44}_i$ can be in flow communication with flow control bypass channel 45, which can have a width of between about 100μ (micron) to about 300μ (micron) and in illustrative embodiments between 190μ (micron) to 210μ (micron) and a length of between about 2.5 mm to about 5.0 mm and in illustrative embodiments between 3.2 mm to 3.8 mm. Sample coalescence trap outlet end $\mathbf{44}_0$ can be in flow communication with sample coalescence trap constriction channel $\mathbf{44}_{ro}$, which can have an initial width of between about 50μ (micron) to about 200μ (micron) and in illustrative embodiments between 100μ (micron) to 140μ (micron) and tapers to a width of between about 20μ (micron) to about 60μ (micron) and in illustrative embodiments between 30μ (micron) to 40μ (micron), and has a length of 150μ (micron) to about 250μ (micron) and in illustrative embodiments between 180μ (micron) to 220μ (micron). The tolerance on the geometry of fluidic features of FIG. 4 of the present teachings can be within 10% and in illustrative embodiments, within 5%.

Regarding dimensions for fluidic features of flow control branch 50 of FIG. 4, flow control bypass channel 45 is in flow communication with flow control primary channel 52, which can have a width of between about 390μ (micron) to about 410μ (micron) and a length of between about 3 mm to about 5 mm. Flow control primary channel 52 can be in flow communication with flow control secondary channel 54, which can have a width of between about 450μ (micron) to about 510μ (micron) and a length of between about 1 mm to about 2 mm. Flow control primary channel chamber 51 and flow control secondary channel chamber 53 can have a diameter of between about 500μ (micron) to about 1 mm. Flow control primary channel 52 can be in flow communication with flow control valve 56, which have a width and length of between about 270μ (micron) to about 330μ (micron). Flow control valve 56 can be in flow communication with flow control valve constriction channel 55, which can have a width of between about 15μ (micron) to about 100μ (micron) and a length of between about 2 mm to about 5 mm. Flow control valve constriction channel outlet end $\mathbf{55}_o$ can be in flow communication with first sample mixing channel section inlet end $\mathbf{62}_i$. The distance between flow control valve constriction channel outlet end $\mathbf{55}_o$ and sample coalescence trap outlet end $\mathbf{44}_o$ can be between about 480μ (micron) to about 720μ (micron). The tolerance on the geometry of a flow control branch of the present teachings can be within 10% and in illustrative embodiments, within 5%.

FIG. 5 depicts an expanded top schematic view of a sample mixing channel and a sample sub-aliquoting branch of a fluidic circuit of the present teachings. Sample mixing channel 60 can have first sample mixing channel section 62, second sample mixing channel section 64 and third sample mixing channel section 66. First sample mixing channel section 62 can have first sample mixing channel section inlet end $\mathbf{62}_i$ and first sample mixing channel section outlet end $\mathbf{62}_o$. First sample mixing channel section inlet end $\mathbf{62}_i$ is tapered so that sample fluid gradually enters the mixing channel to ensure that mixing in the sample mixing channel and trapping of the sample fluid in sample sub-aliquoting branch 90 is consistent. First sample mixing channel section inlet end $\mathbf{62}_i$ is tapered initially between about 35μ (micron) to about 45μ (micron) wide at the taper end of first sample mixing channel section 62. Sample mixing channel 60 can have a width after the tapered section of between about 135μ (micron) to about 165μ (micron) and an overall length of between about 5 mm to about 15 mm. The number of serpentine coils in sample mixing channel 60 can be between about 2 to about 6 coils. The tolerance on the geometry of a sample mixing channel of the present teachings can be within 10%, and in illustrative embodiments within 5%.

Sample mixing channel 60 can be in flow communication with sample sub-aliquoting channel 92. Sample sub-aliquoting channel 92 can have a width of between about 190μ (micron) to about 210μ (micron) and a length of between about 7 mm to about 8 mm. As depicted in FIG. 5, in flow communication with sample sub-aliquoting channel 92 are first fission trap section 70 and second fission trap section 80. First fission trap section 70 can have first fission trap 72 and second fission trap section 80 can have second fission trap 82, where each fission trap can be 315μ (micron) to about 385μ (micron) in width and between about 450μ (micron) to about 550μ (micron) in length. First fission trap 72 and second fission trap 82 can have first fission trap inlet end $\mathbf{72}_i$ and second fission trap inlet end $\mathbf{82}_i$, respectively, where each inlet end can have a width of between about 215μ (micron) to about 235μ (micron). First fission trap 72 and second fission trap 82 can be in flow communication with first fission trap constriction channel 71 and second fission trap constriction channel 81, respectively, where each fission trap constriction channel can be 70μ (micron) to about 90μ (micron) in width and between about 190μ (micron) to about 230μ (micron) in length. First fission trap constriction channel 71 and second fission trap constriction channel 81 are in flow communication with first sample fission trap outlet chamber constriction channel 73 and second sample fission trap outlet chamber constriction channel 83, respectively, where each sample fission trap outlet chamber constriction channel can be 20μ (micron) to about 30μ (micron) in width and between about 750μ (micron) to about 1.75 mm in length. First fission trap chamber 93, second fission trap chamber 95, first sample fission trap outlet chamber 74, second sample fission trap outlet chamber 84, and sample sub-aliquoting chamber 97 can have a diameter of between about 500μ (micron) to about 1 mm. First fission trap chamber 93 and second fission trap chamber 95 are in flow communication with first fission trap chamber channel 94 and second fission trap chamber channel 96, respectively, where each first fission trap chamber channel can be 190μ (micron) to about 210μ (micron) in width and between about 1 mm to about 2 mm in length. The tolerance on the geometry of fluidic features of a sample sub-aliquoting branch of the present teachings can be within 10%, and in illustrative embodiments within 5%.

According to the present teachings, for illustrative dimensions disclosed for various fluidic elements of FIG. 2 through FIG. 5, an illustrative height dimension can be between about 160μ (micron) to about 200μ (micron) with a tolerance that can be within 10%, and in illustrative embodiments within 5%. Any dimension provided herein for any element, including any element of any figure, can have a tolerance in certain embodiments within 10%, and in illustrative embodiments within 5% of an indicated measurement or high or low end of a range of measurements.

Various embodiments of fluidic circuit 100 of FIG. 1, and various embodiments of fluidic circuits derived using combinations of various branches thereof, can be fabricated using, for example, but not limited by, various soft lithographic micro-embossing techniques. In various embodiments of a device according to the present teachings, a substrate, such as substrate 15 of FIG. 1, can be an optically transmissive polymer, providing good optical transmission from, for example at least about 85% t0 90% optical transmission over a wavelength range of about 400 nm to about 800 nm. Examples of polymeric materials having good optical transmission properties for the fabrication of various embodiments of a fluidic circuit of the present teachings include organosilicon polymers, such as polydimethylsiloxane (PDMS), cyclic-olefin polymers (COP), cyclic-olefin copolymers (COC), polystyrene polymers, polycarbonate polymers, and acrylate polymers. According to the present teachings, a variety of fabrication micro-forming methods that utilize, for example, but not limited by, micro-milling, micro-stamping, and micro-molding, can be matched to substrate material properties.

Figure 6:
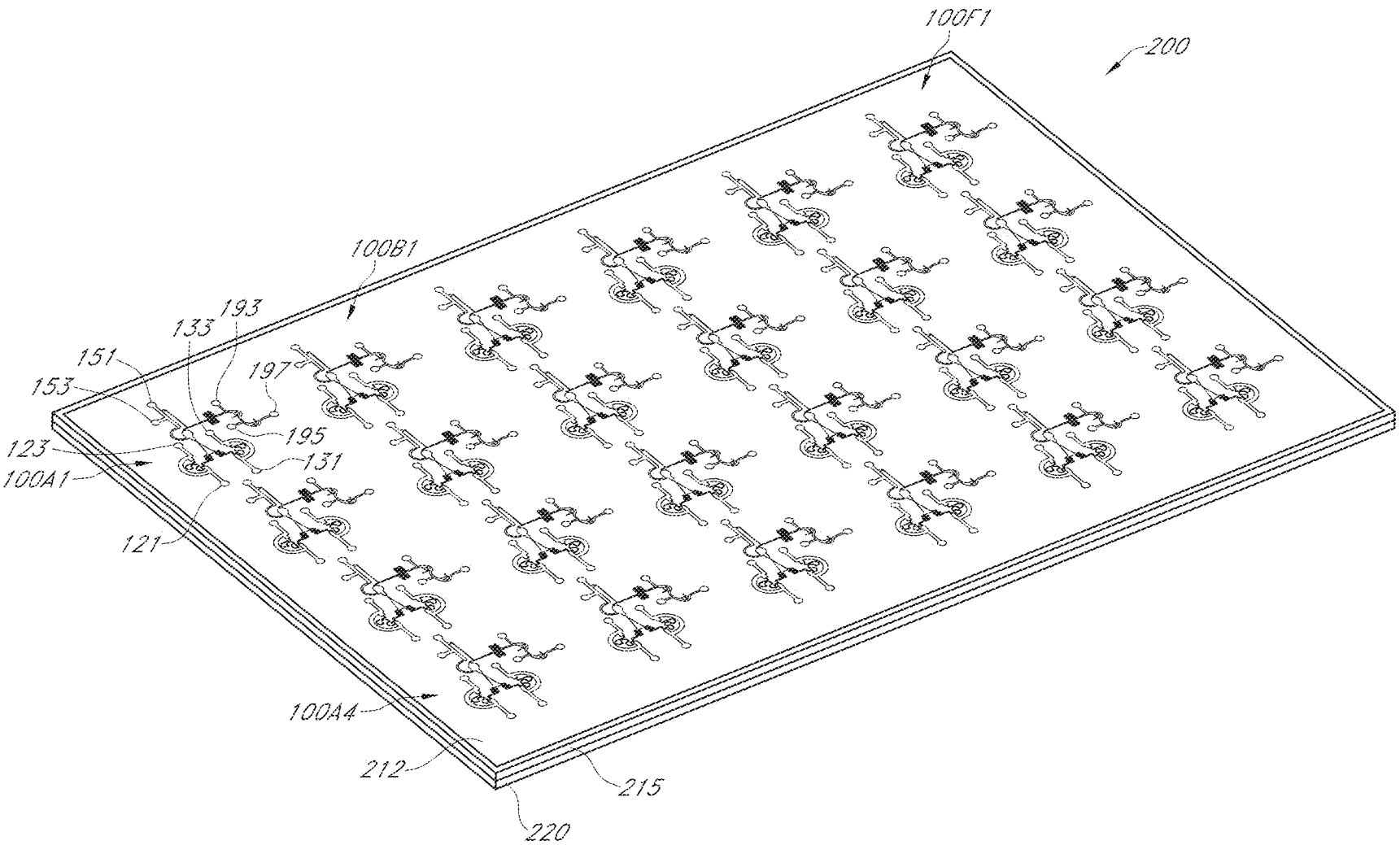
FIG. 6 depicts a perspective view of a fluidic device for precision liquid handling of droplets of the present teachings.

FIG. 6 depicts a perspective view of a fluidic device for precision liquid handling of fluids (e.g. droplets) of the present teachings. A fluidic circuit, such as fluidic circuit 100A1 of FIG. 6, can be patterned in various arrangements, such as a linear or 2-dimensional array. As depicted for fluidic device 200 in FIG. 6, fluidic circuits are depicted in a 2-dimensional array defined by rows, such as a row defined by 100A1 through 100F1, and a column, such as a column defined by 100A1 through 100A4. Such arrays may be useful for integration with other formats well-known in biological testing, such as various microtiter plate formats, though any arrangement of fluidic chambers on a substrate for any type of experimental protocol can be fabricated. For example, the array can include between 4 and 256, or between 4 and 128, between 4 and 64, between 8 and 48, between 12 and 48, or 24 fluidic circuits provided herein. Substrate 215 can have a first surface on which the fluidic chambers are fabricated that can be covered using an optically transmission cover, such as cover 220 of fluidic device 200 of FIG. 6, which can readily enable optical detection. It is noteworthy that the "cover" can be on the bottom or the top of the fluidic device, thus the device can be as indicated in FIG. 6 or it can be flipped such that the cover is on top. Various optically transmission covers can have at least the same optical transmission as those of substrate 15 of fluidic circuit 100 of FIG. 1 and substrate 215 of fluidic device 200 of FIG. 6, for which optical transmission can be at least about 85% to 90% over a wavelength range of between about 400 nm to about 800 nm. Various covers, such as cover 220 of FIG. 6, can be selected from a variety of glass materials, such as a glass slide, or can be a polymeric material, such as any of the exemplary polymeric materials suitable for substrate 15 of fluidic circuit 100 of FIG. 1 and substrate 215 of fluidic device 200 of FIG. 6, which can include organosilicon polymers, such as polydimethylsiloxane (PDMS), cyclic-olefin polymers (COP), cyclic-olefin copolymers (COC), polystyrene polymers, polycarbonate polymers, and acrylate polymers. The substrate thickness for various embodiments of fluidic circuit 100 of FIG. 1 and fluidic device 200 of FIG. 6 can be from between about 700μ (microns) to about 1300μ (microns).

Figure 7:
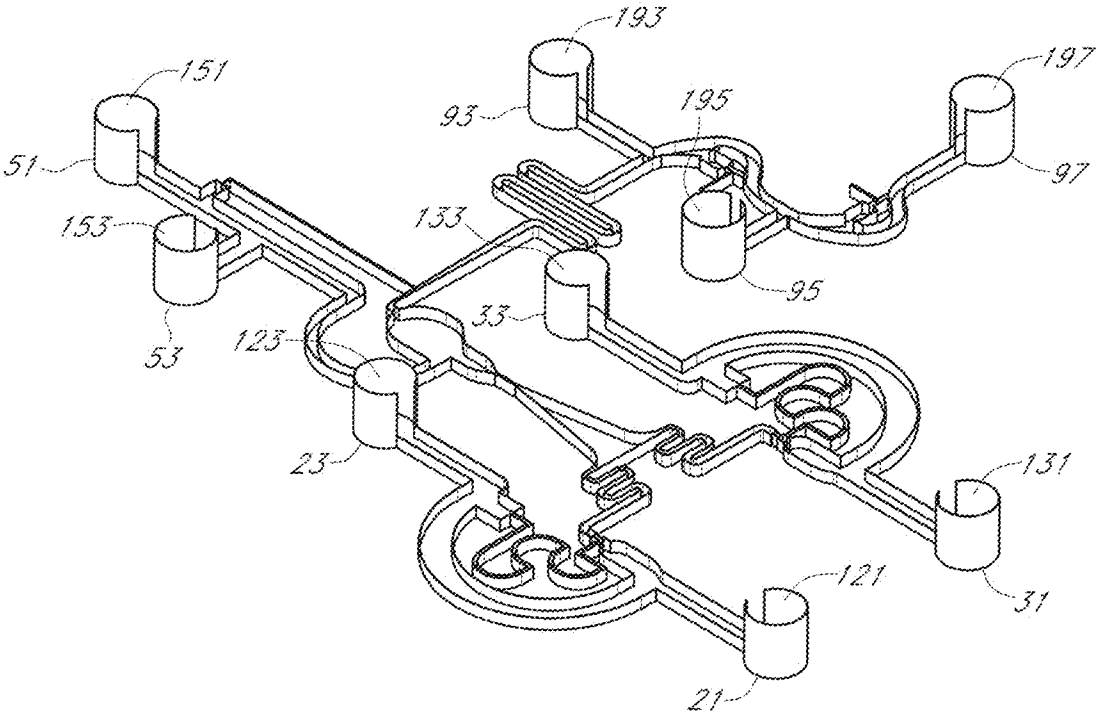
FIG. 7 is an expanded perspective view of a fluidic circuit of the present teachings, depicting flow communication with ports externally-accessible to the fluidic circuit.

Second substrate surface 212 of FIG. 6, opposing the first substrate surface on which various embodiments of a fluidic circuit of the present teachings can be formed, can have a variety of ports fabricated through the body of the substrate to provide external flow communication to various substructures of a fluidic circuit of the present teachings, such as depicted for representative fluidic circuit 100A1 of FIG. 6; of which a representative fluidic circuit, such as fluidic circuit 100 of FIG. 1, is shown in expanded perspective view in FIG. 7. For example, with respect to external flow communication for a sample branch, such as sample capture branch 10 of FIG. 1, first sample capture section filling port 121 of FIG. 6 and FIG. 7 can provide external flow communication to first sample filling chamber 21 of first sample capture section 20 of FIG. 1, while first sample filling port 131 of FIG. 6 and FIG. 7 can provide external flow communication to first sample filling chamber 31 of second sample capture section 30 of FIG. 1. Similarly, second sample filling port 123 of FIG. 6 and FIG. 7 can provide external flow communication to second sample filling chamber 23 of first sample capture section 20 of FIG. 1, while second sample filling port 133 of FIG. 6 and FIG. 7 can provide external flow communication to second sample filling chamber 33 of second sample capture section 30 of FIG. 1. With respect to external flow communication for a flow control branch, such as flow control branch 50 of FIG. 1, flow control port 151 of FIG. 6 and FIG. 7 can provide external flow communication to flow control primary channel chamber 51 of flow control branch 50 of FIG. 1, proving external flow communication to a flow control primary channel 52 thereby. Similarly, flow control port 153 of FIG. 6 and FIG. 7 can provide external flow communication to flow control secondary channel chamber 53 of flow control branch 50 of FIG. 1, proving external flow communication to a flow control secondary channel 54 thereby. With respect to external flow communication for a sample sub-aliquoting branch, such as sample sub-aliquoting branch 90 of FIG. 1, fission trap chamber port 193 can provide external flow communication to first fission trap chamber 93 of sample sub-aliquoting branch 90 of FIG. 1. Similarly, fission trap chamber port 195 can provide external flow communication to second fission trap chamber 95 of sample sub-aliquoting branch 90 of FIG. 1. Finally, sample sub-aliquoting port 197 can provide external flow communication to sample sub-aliquoting chamber 97 of sample sub-aliquoting branch 90 of FIG. 1. Furthermore, not shown in the figure, fission trap outlet chamber ports 174 and 184 can provide external flow communication to fission trap outlet chambers 74 and 84, respectively.

According to the present teachings, on-device liquid handling can be externally actuated in manual or automated mode using standard laboratory liquid handling equipment. According to various embodiments of components, devices and methods of the present teachings, a pressure applied at or between ports can be used as a motive force for moving liquids, for example, from one branch of a fluidic circuit to another branch of a fluidic circuit. According to the present teachings, a motive force for on-device liquid handling can be externally actuated by applying a decreased or negative pressure at a port or between ports or by applying an increased or a positive pressure at a port or between ports. Given that a full vacuum by definition is the absence of pressure, for example, 0 torr, and given that 1 standard atmosphere of pressure is, for example 760 torr, then a negative pressure is a decreased pressure less than 760 torr, for example, and a positive pressure is an increased pressure greater than 760 torr, for example. In that regard, on-device liquid handling for various embodiments of components, devices and methods of the present teachings can be externally actuated using any manual or automated standard laboratory liquid handling equipment, such as manual or automated pipetting systems utilizing solid or liquid displacement, that can provide a pressure from between about 720 torr to about 800 torr, which is about +/−40 torr from 1 standard atmosphere of pressure.

FIG. 8A through FIG. 12B illustrate generally various exemplary methods for using embodiments of fluidic components and devices of the present teachings. For FIG. 8A through FIG. 12B, a black chamber represent a chamber that is in flow communication with an external port that is open, while a white chamber represent a chamber that is in flow communication with an external port that is closed.

Figure 8A:
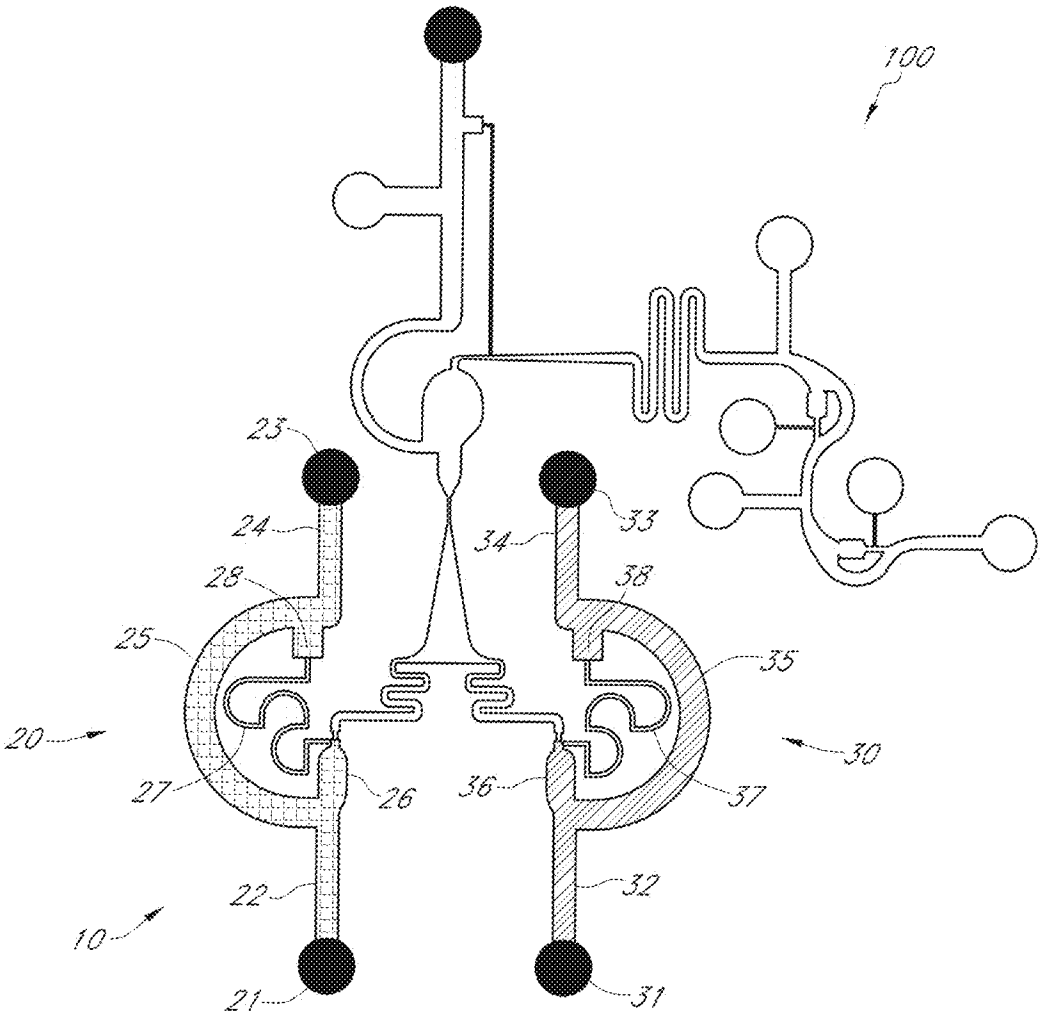
FIG. 8A and FIG. 8B depict loading a plurality of samples on a device of the present teachings.
Figure 8B:
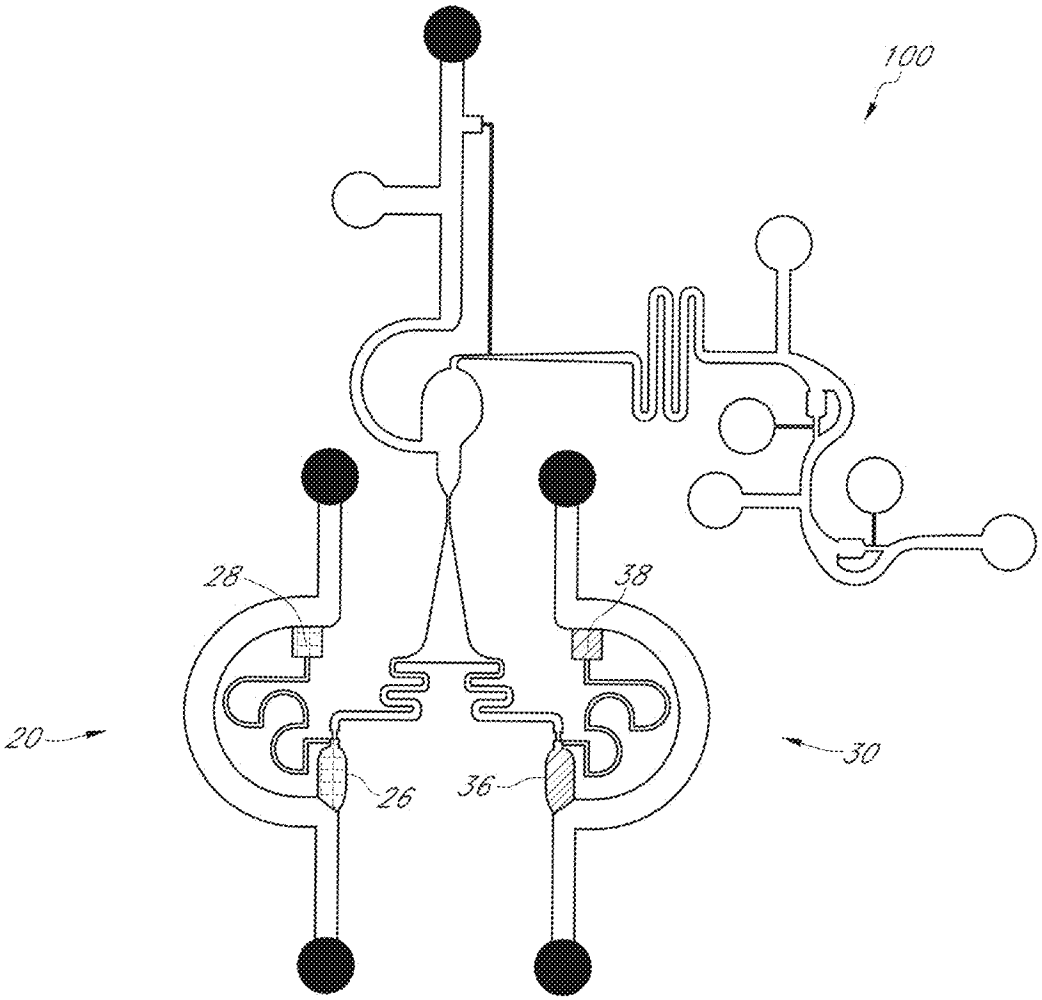

FIG. 8A and FIG. 8B illustrate generally an exemplary method of the present teachings for sample loading, in which a sample capture trap and a sample capture value of a sample capture section are loaded. In FIG. 8A, a first sample can be delivered into either first sample filling chamber 21 of first sample capture section 20, or second sample filling chamber 23 of first sample capture section 20, completely filling first sample filling bypass channel 25, as well as filling first sample capture trap 26 and first sample capture valve 28. Similarly, a second sample can be delivered into either first sample filling chamber 31 of second sample capture section 30, or second sample filling chamber 33 of second sample capture section 30, completely filling second sample filling bypass channel 35, as well as filling second sample capture trap 36 and second sample capture valve 38. In FIG. 8B, excess sample can be removed from a bypass channel, leaving a sample capture trap loaded and a sample capture valve loaded or primed. In that regard, excess first sample can be removed from first sample filling bypass channel 25 of first sample capture section 20 through either first sample filling chamber 21 of first sample capture section 20, or second sample filling chamber 23 of first sample capture section 20, leaving first sample capture trap 26 loaded and first sample capture valve 28 loaded or primed. Similarly, excess second sample can be removed from second sample filling bypass channel 35 of second sample capture section 30 through either first sample filling chamber 31 of second sample capture section 30, or second sample filling chamber 33 of second sample capture section 30, leaving second sample capture trap 36 loaded and second sample capture valve 38 loaded or primed. As previously noted, all steps for loading a sample capture trap and a sample capture valve can be done in manual or automated mode, providing for sequential or simultaneous loading or removal of a sample from either a first or second filling chamber.

Figure 9A:
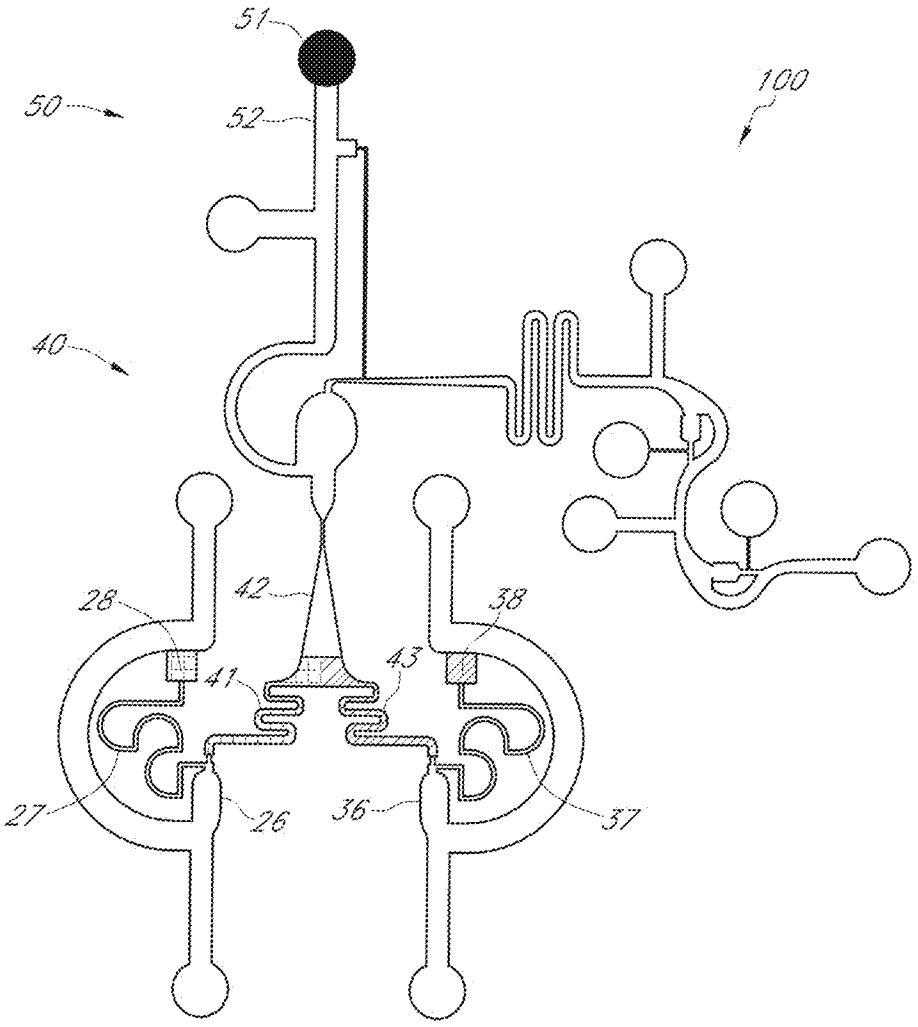
FIG. 9A and FIG. 9B depict merging a plurality of samples to form a combined sample on a device of the present teachings.
Figure 9B:
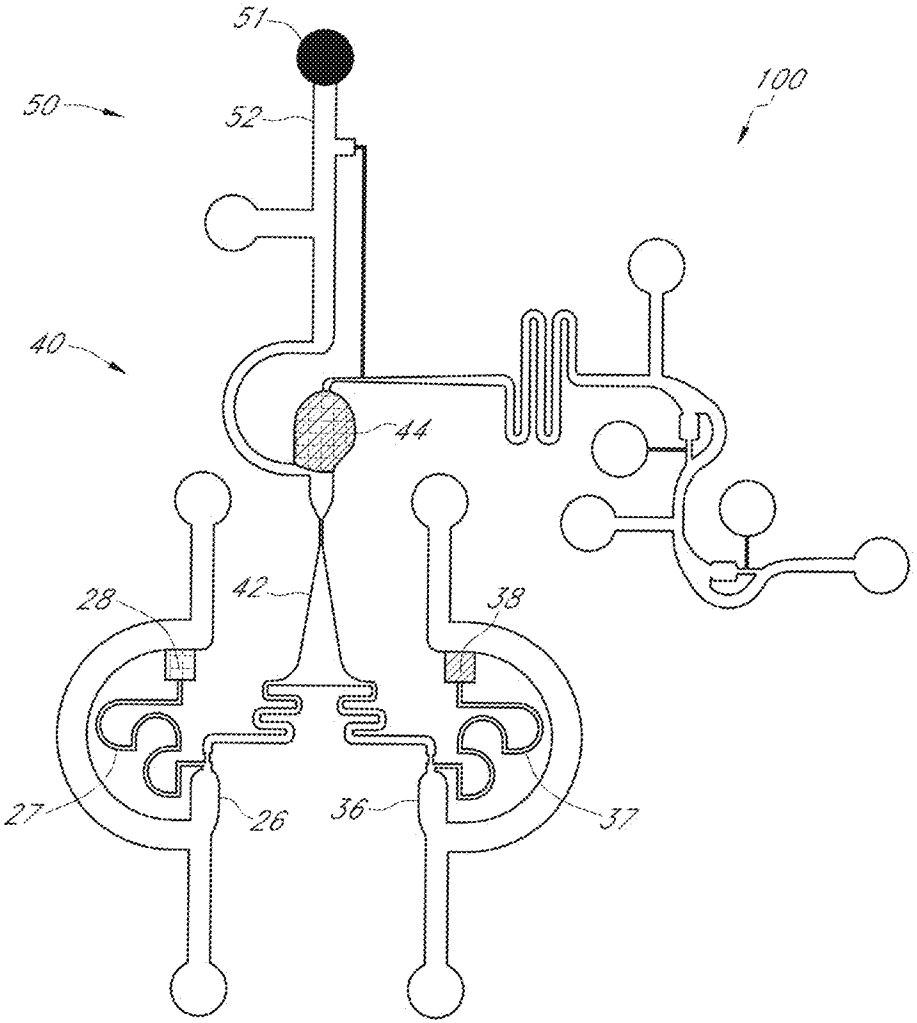

FIG. 9A and FIG. 9B illustrate generally an exemplary method of the present teachings for forming a coalescent sample from a first and a second sample loaded as previously disclosed herein for FIG. 8A and FIG. 8B. In FIG. 9A, with all other external ports closed, a decreased pressure or a negative pressure of between about 1 torr to about 40 torr can be applied to flow control port 151 of FIG. 7 with all other external ports closed, drawing a first sample from first sample capture trap 26 into first sample convergent channel 41 and drawing a second sample from second sample capture trap 36 into second sample convergent channel 43, then into sample convergent inlet chamber 42. First sample capture valve 28 and first sample capture constriction channel 27 are in flow communication with first sample convergent channel 41. Similarly, second sample capture valve 38 and second sample capture constriction channel 37 are in flow communication with second sample convergent channel 43. As previously disclosed herein, a sample capture valve and a sample capture constriction channel can provide fluidic resistance that assists in the process of the simultaneous transfer of a first sample from a first sample capture trap through a first sample convergent channel and a second sample from a second sample capture trap through a second sample convergent channel into a sample convergent inlet chamber. In FIG. 9B, the coalescent sample formed from the first sample and the second sample are shown completely transferred from sample convergent inlet chamber 42 to sample coalescence trap 44.

Figure 10A:
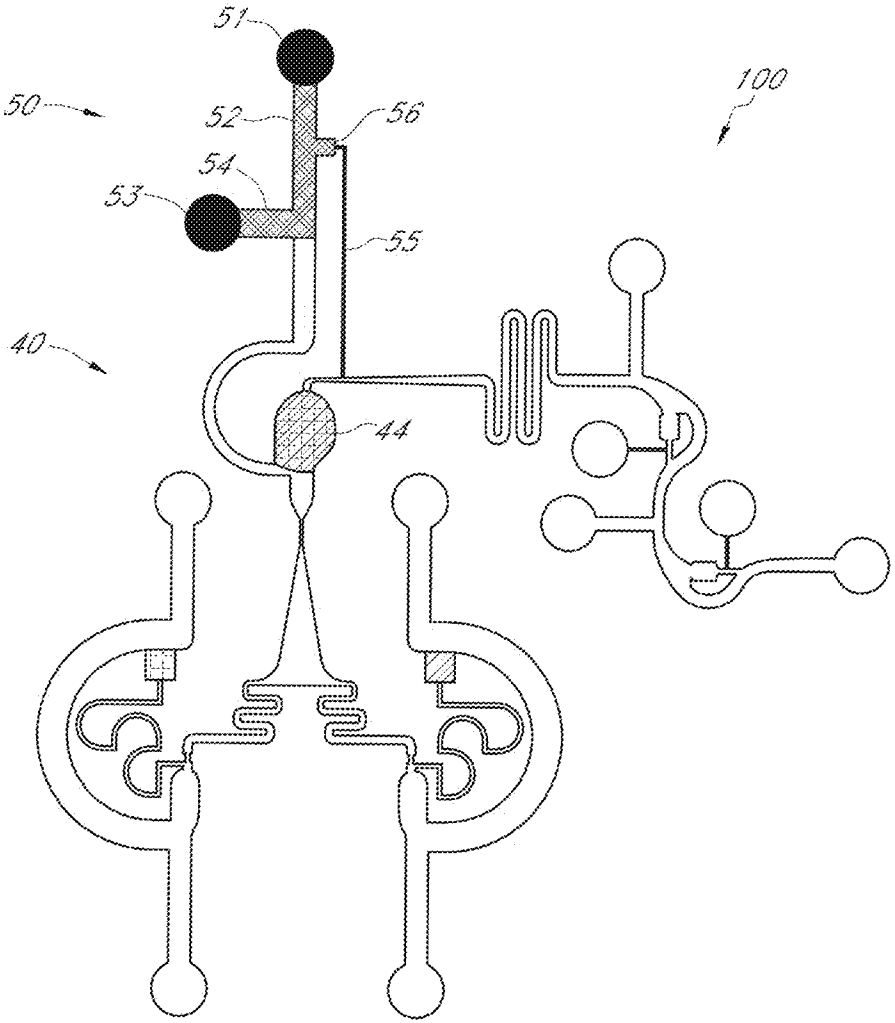
FIG. 10A and FIG. 10B depict loading a liquid valve of a flow control branch of a device of the present teachings.
Figure 10B:
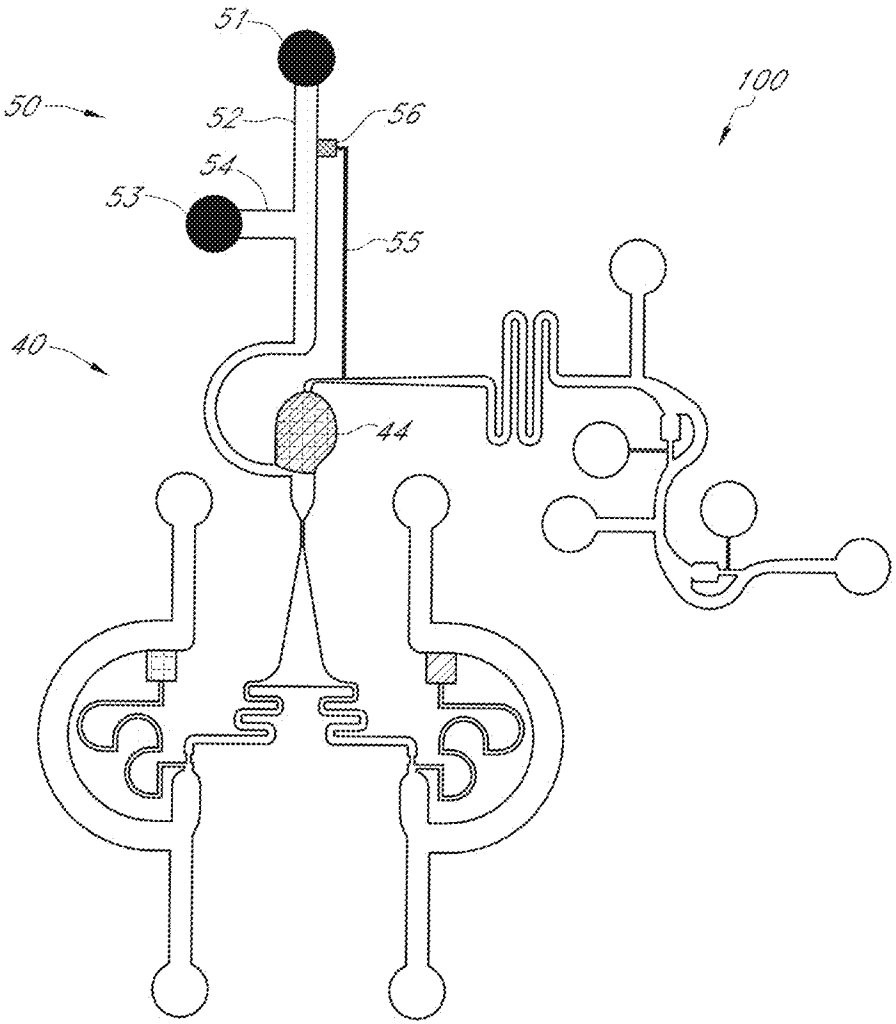

FIG. 10A and FIG. 10B illustrate generally an exemplary method of the present teachings for priming a flow control valve, such as flow control valve 56 of FIG. 10A and FIG. 10B. In FIG. 10A, with a priming liquid, such as, for example, but not limited by, deionized water, a buffer, or other diluent, can be loaded into flow control primary channel chamber 51 and into flow control primary channel 52 until it flows into flow control secondary channel 54. In FIG. 10B, after excess priming liquid has been removed from flow control primary channel 52 and flow control secondary channel 54, flow control branch 50 is enabled for the process of transferring a coalescent sample in sample coalescence trap 44 to a sub-aliquoting branch.

Figure 11A:
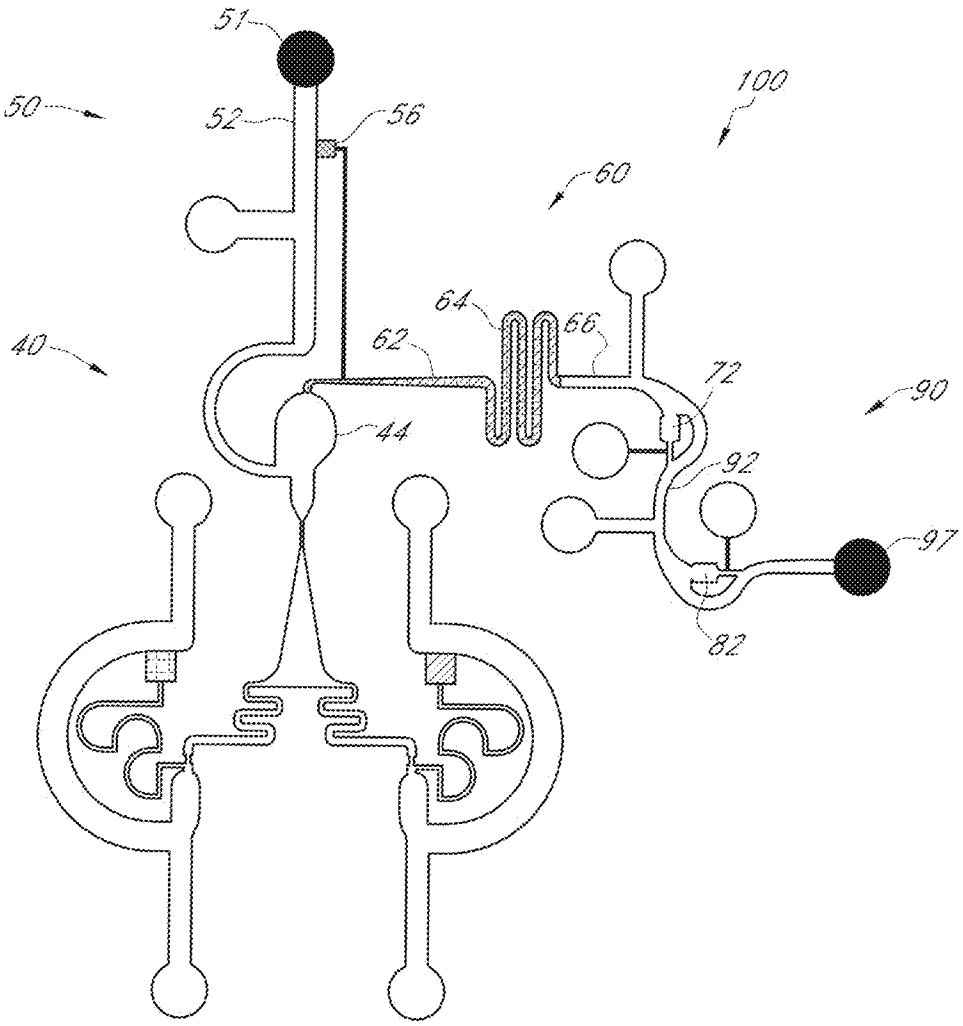
FIG. 11A and FIG. 11B depict an exemplary method of the present teachings for mixing and transferring a coalescent sample (i.e. a combined sample) in a sample coalescence trap through a mixing channel and into plurality of fission traps creating fission samples in a sub-aliquoting branch.
Figure 11B:
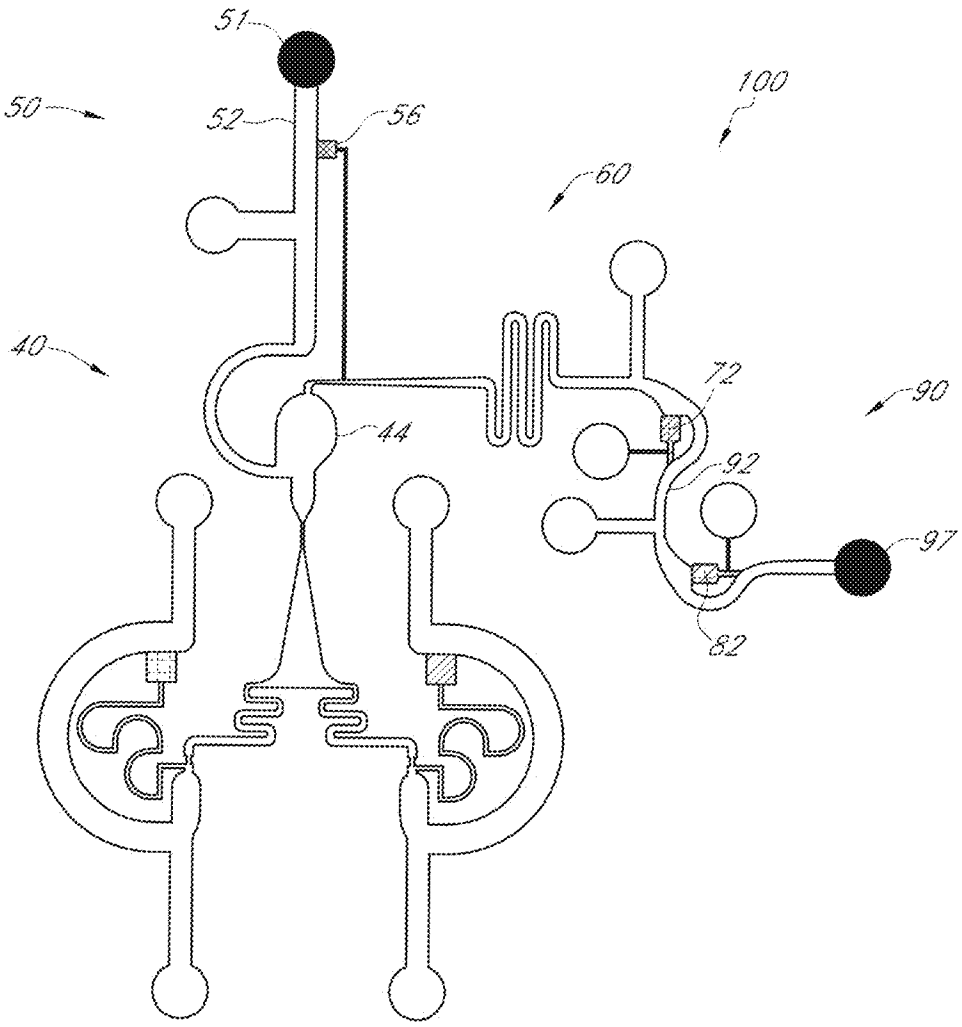

FIG. 11A and FIG. 11B illustrate generally an exemplary method of the present teachings for transferring a coalescent sample in a sample coalescence trap through a mixing channel and into a sub-aliquoting branch. As depicted in FIG. 11A, after flow control valve 56 has been primed as described for FIG. 10A and FIG. 10B, an increased pressure or positive pressure of between about 1 torr to about 40 torr can be applied to sample sub-aliquoting port 197 of FIG. 7, while flow control port 151 of FIG. 7 is open and all other external ports are closed, drawing a coalescent sample in coalescence trap 44 into first sample mixing channel section 62 of sample mixing channel 60, and into second sample mixing channel section 64. As previously disclosed herein, for various embodiments of fluidic components, devices and methods, mixing that can occur in a coalescence branch may be sufficient, while for other embodiments of fluidic components, devices and methods, mixing channel 60 may be required to provide a homogenous coalescent sample. Though not shown in FIG. 11A, a coalescent sample drawn through a sample sub-aliquoting branch to a sample sub-aliquoting chamber can fill each sample fission trap of a sub-aliquoting branch, as well as filling at least a portion of a sample sub-aliquoting channel. As depicted in FIG. 11B, after removing all of an excess of a coalescent sample from sample sub-aliquoting channel 92, sample fission trap 72 and sample fission trap 82 are filled with a defined portion of a coalescent sample.

Figure 12A:
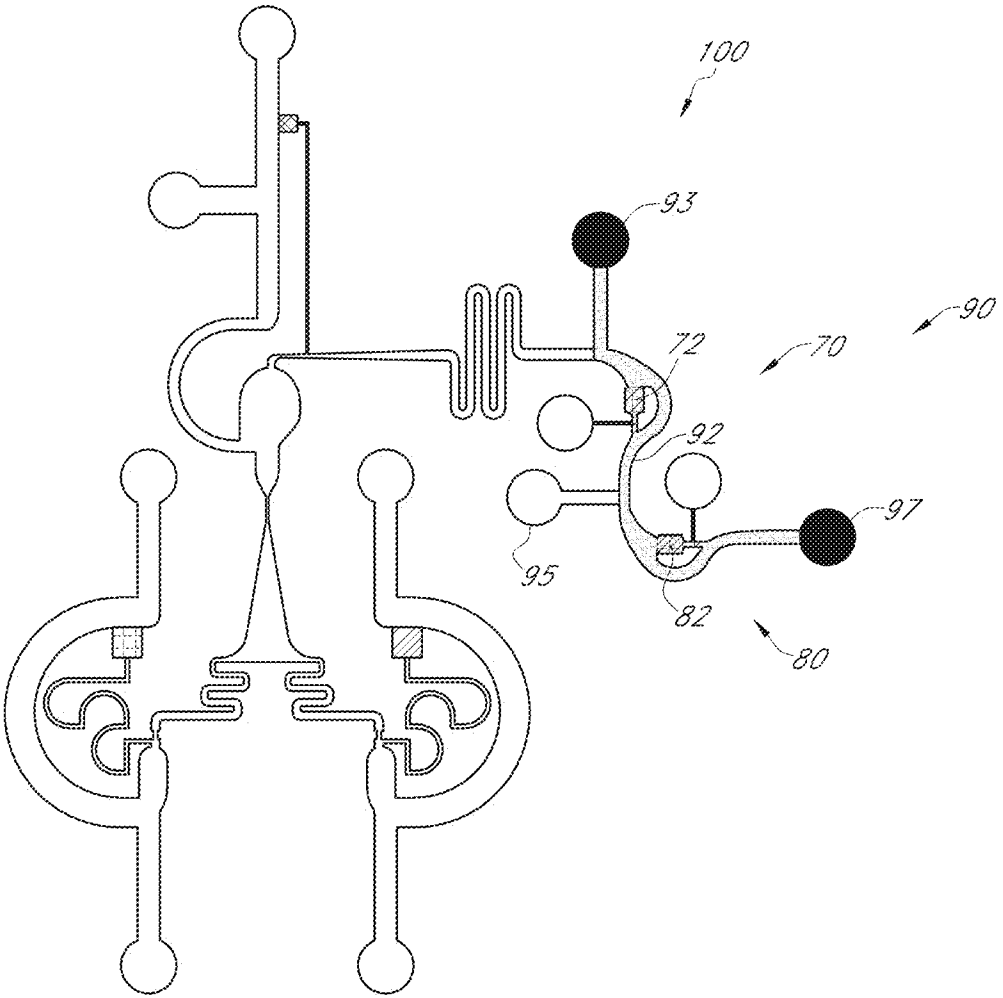
FIG. 12A and FIG. 12B depict an exemplary method of the present teachings for loading and washing a sub-aliquoting branch.
Figure 12B:
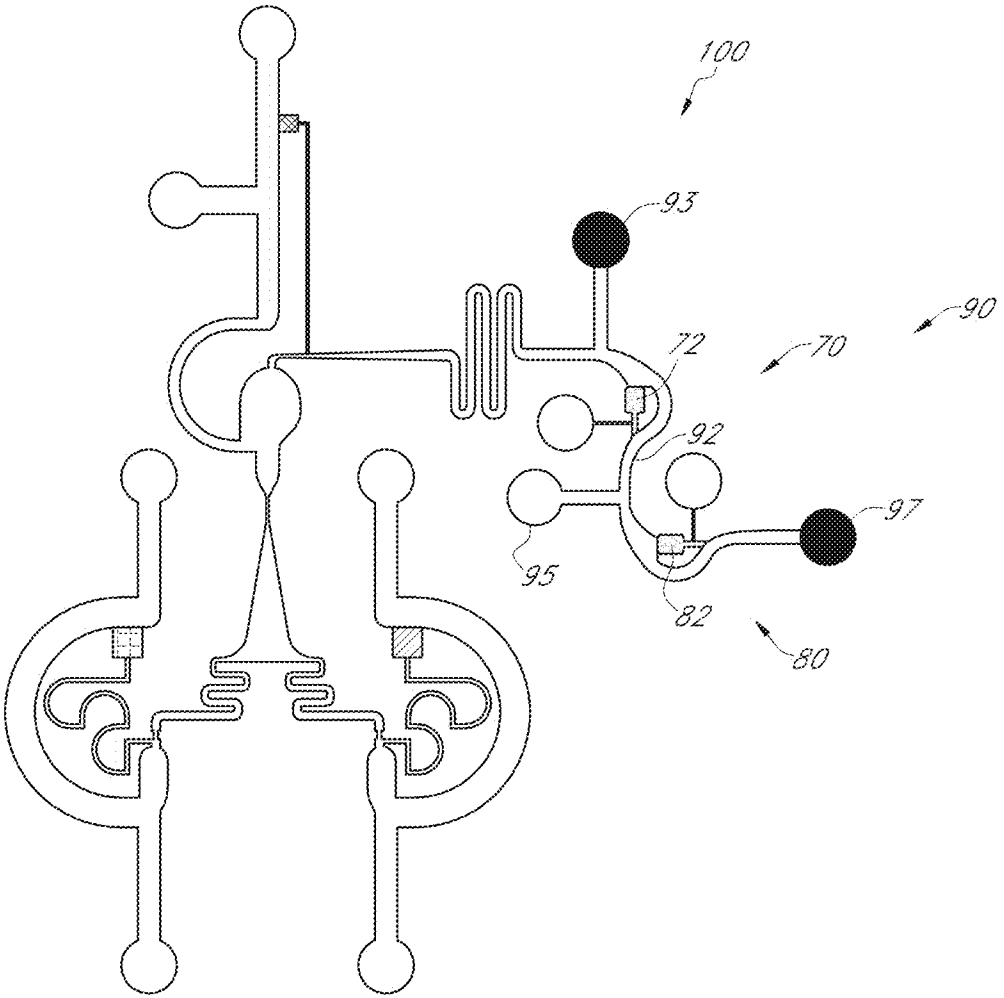

FIG. 12A and FIG. 12B illustrate generally an exemplary method of the present teachings for loading and washing a sub-aliquoting branch. In FIG. 12A, with sample sub-aliquoting port 197 of FIG. 7 and fission trap chamber port 193 of FIG. 7 open, a test sample, a reagent solution such as a detection reagent, or a washing solution, for example a buffer such as phosphate-buffer saline (PBS), can be delivered through sample sub-aliquoting port 197 to fill a section of sub-aliquoting branch 90 between fission trap chamber 93 and sample sub-aliquoting chamber 97. In FIG. 12B, a decreased pressure or negative pressure of between about 1 torr to about 40 torr can be applied to sample sub-aliquoting port 197 of FIG. 7, while fission trap chamber port 193 of FIG. 7 is open and all other external ports are closed, drawing the loading or washing solution from sub-aliquoting branch 90, leaving fission trap 72 of first fission trap section 70 and fission trap 82 of second fission trap section 80 filled with the loading or washing solution. Though FIG. 12A and FIG. 12B depict loading and washing the entire section from sub-aliquoting branch 90 between fission trap chamber 93 and sample sub-aliquoting chamber 97, each fission trap, such as fission trap 72 of first fission trap section 70 and fission trap 82 of second fission trap section 80, can be loaded or washed separately. For example, fission trap 72 of first fission trap section 70 can be loaded or washed by applying the exemplary method disclosed for FIG. 12A and FIG. 12B using fission trap chamber port 193 and fission trap chamber port 195 of FIG. 7. Similarly, fission trap 82 of second fission trap section 80 can be loaded or washed by applying the exemplary method disclosed for FIG. 12A and FIG. 12B using fission trap chamber port 195 and sub-aliquoting port 197 of FIG. 7.

In addition to various liquid handling processes exemplified by FIG. 8A through FIG. 12B, various embodiments of fluidic components, devices and methods of the present teachings can be used for a variety of biological assays and pharmaceutical analyses.

Biological and Biochemical Applications

Fluidic devices provided herein can be used in any biological or biochemical method in which two samples are coalesced and/or a sample (e.g. a coalesced sample) is sub-aliquoted. A skilled artisan will recognize that a large number of such methods exist. Accordingly, a large number of samples can be delivered into a sample capture trap and/or a sample fission trap of a fluidic device provided herein. Such samples can include nucleic acid samples, protein samples, carbohydrate samples, buffers, reagents, organic compounds such as small organic candidate drug compounds, or combinations thereof, such as biological samples that are mixtures of these and other biochemicals, for example. Such biological samples can include, as non-limiting examples, blood, or a fragment thereof, such as for example plasma or sera, tissue, tumor biopsy, sputum, cerebrospinal fluid, and cell culture supernatant. In addition, any reagent that is used in such biological or biochemical methods. Such biological or biochemical methods can include, for example, immunological methods such as immunoassays (e.g. ELISAs), including sandwich immunoassays, sample preparation methods, nucleic acid isolation and/or purification, cell culturing and imaging, nucleic acid assays, pharmaceutical drug candidate testing, or anti-drug antibody (ADA) assays.

In certain embodiments, for performance of biological assays using a fluidic device provided herein, a detection system, such as an optical detection system can be in optical communication with the sample fission traps. For such embodiments, the device cover through which an optical detection system is in optical communication is ideally transparent, for example transparent glass or transparent plastic.

In certain embodiments, a first fission trap and a second fission trap can be loaded, and the surfaces of such traps coated with a first test sample and a second test sample. A target antibody or antigen if present in such first test sample or second test sample, for example, can coat the surface of the first fission trap and the second fission trap. The coated fission traps can then optionally be rinsed with a buffer, such as PBS or any buffer used in an immunoassay and then the surface of the fission traps can be blocked with an immunoassay blocking reagent, which are known in the art. Then a first test sample, such as a blood (or fraction thereof e.g. plasma or sera) from a first subject and a second test sample, which can be a blood sample from a second subject, or in non-limiting examples can be a control sample, can be delivered to the coated fission traps and incubated. Optionally, another antibody can be delivered to the coated fission traps and incubated. Then antibodies or antigens that bind components (if present) in the test samples that bound the coated antibody or antigen are delivered to the coated fission traps. This fluidic processing within the fission traps and associated fluidic trap sections can be achieved by delivering samples into the fission traps through fission trap chambers as illustrated in FIG. 11B and FIG. 12.

As another non-limiting example, an ADA assay can be performed using a fluidic device provided herein. A skilled artisan will realize that a fluidic device provided herein can be used in different ways to perform an ADA assay. As a non-limiting example, a biotherapeutic drug such as a biotherapeutic antibody can be delivered to a first fission trap and a control antibody can be delivered to a second fission trap by delivery of samples into each fission trap chamber of an array of microfluidic circuits on a microfluidic device provided herein, through fission trap ports. The biotherapeutic antibody and control antibody (if used) can be incubated in the fission traps to allow the biotherapeutic antibody and control antibody to coat the surface of the fission traps.

As a further step of the ADA assay, sera samples from subjects to whom the biotherapeutic antibody has been administered are each mixed with an acidic reagent as will be understood for ADA assays, and the acidified sera samples are each delivered to a first sample capture trap of a different microfluidic circuit on the microfluidic device by delivery of the acidified sera sample to a first sample filling chamber through a first sample filling port. A pH neutralizing reagent with an fluorescently-labeled antibody that recognizes the biopharmaceutical antibody, which will be referred to as a detection reagent, is applied to each of the second sample capture traps by delivery of the detection reagent to a second sample filling chamber through a second sample filling port. The sample capture traps are filled using the method steps as provided herein in FIG. 8A and FIG. 8B. A captured acidified sera sample droplet within each first sample capture trap and a captured droplet of the detection reagent within each second sample capture trap are delivered into the sample coalescence trap and coalesced therein to form a coalescent sample droplet using method steps provided in FIG. 9A and FIG. 9B. Each flow control valve is then primed using the method illustrated in FIG. 10A and FIG. 10B. Then each coalescent sample droplet is moved into a sample mixing channel where it is mixed as illustrated in FIG. 11A, and then the mixed coalescent sample droplet is sub-aliquoted into the first fission trap and the second fission trap, coated with the biotherapeutic antibody and control antibody, respectively, as discussed above. Before arriving at the first fission trap and the second fission trap the pH of the coalescent sample droplet is increased to a pH at which antibodies will bind their cognate antigens due to the mixing of the acidified sera sample droplet and the detection reagent, which is pH neutralizing. If an anti-drug antibody is present in a subject sera sample, it will bind to the biotherapeutic antibody immobilized on the fission trap surface of the first fission trap but not the control antibody-coated surface of the second fission trap. The fission traps are then rinsed and refilled with a buffer. Then light from a light source is passed into the first fission trap and the second fission trap of the array of fluidic circuits, either in a scanning manner or simultaneously, and fluorescence is detected by a fluorescence detector. Positive fluorescence from a biotherapeutic-coated sample fission trap but not a control antibody-coated sample fission trap is indicated of the presence of an anti-drug antibody in the subject sample applied to that microfluidic circuit.

In another non-limiting example, a microfluidic device provide herein can be used to perform one or more sample preparation steps in a next-generation (i.e. massively parallel) sequencing workflow. For example, a plurality of samples can each be processed separately within different microfluidic circuits provided herein patterned as an array on a microfluidic device provided herein. For example, nucleic acid samples from different subjects are fragmented and phosphorylated. The nucleic acid samples are then each delivered to a first sample capture trap of a different microfluidic circuit on the microfluidic device by delivery of the nucleic acid sample to a first sample filling chamber through a first sample filling port. A reagent that includes nucleic acid Y adapters and ligation reagents, referred to as Y adapter ligation reagent, is applied to each of the second sample capture traps by delivery of the Y adapter ligation reagent to a second sample filling chamber through a second sample filling port. The sample capture traps are filled using the method steps as provided herein in FIG. 8A and FIG. 8B. A captured nucleic acid sample droplet within each first sample capture trap and a captured droplet of the Y adapter ligation reagent within each second sample capture trap are delivered into the sample coalescence trap and coalesced therein to form a coalescent sample droplet using method steps provided in FIG. 9A and FIG. 9B. Each flow control valve is then primed using the method illustrated in FIG. 10A and FIG. 10B. Then each coalescent sample droplet is moved into a sample mixing channel where it is mixed as illustrated in FIG. 11A, and then the mixed coalescent sample droplet is sub-aliquoted into a plurality of fission traps each containing a different set of primer pairs for target amplification to create a plurality of targeted amplification reaction mixtures in each of the fission traps. Then, the targeted amplification reaction mixtures can be removed from the fission traps by pulling it out of the trap using a pipettor to create a negative pressure differential through a port in flow communication with an outlet chamber (e.g. fission trap outlet chambers 74 and 84 of FIG. 1) in flow communication with each of the fission traps, typically after closing all other ports on the fluidic device. Such a method is facilitated by using a pipette small enough to withdraw the fluid volume in each fission trap, which in an exemplary embodiment is 35 nl, and could be for example between 20 nl and 250 nl, or 25 nl and 200 nl, or 30 nl and 100 nl, or 30 nl and 50 nl. As another example of how the amplification reaction mixtures (or any fluid captured in a fission trap) can be removed from the device, in this example where a pipettor that has a minimum capacity greater than the volume of the liquid in the fission trap, all ports can be closed on a fluidic device of FIG. 1 except for a port in flow communication with fission trap outlet chambers (e.g. 74, 84, etc.) and a port in flow communication with fission trap chamber 93, to remove the contents from fission trap 72, or a port in flow communication with fission trap chamber 95 or sub-aliquoting outlet chamber 97, to remove the contents from fission trap 84, to help assure the contents pipetted into the device do not mix with the other sub-aliquot trap. Then a small volume (e.g. 1 ul, 2 ul, 5 ul, or between 1 ul and 5 ul or between 1 ul and 10 ul) of liquid such as a buffer or water can be applied to the fission trap with a pipettor through a port in flow communication with an outlet chamber in flow communication with the fission trap, to mix it with the fluidic contents of the fission trap, and then the mixture of the applied liquid and fission trap contents can be withdrawn from the device through the same port using the pipettor. Once withdrawn from the device, the amplification reaction mixtures can then be pipetted into wells of a microtiter plate for performing an amplification reaction and/or other next generation sequencing processing before performing a sequencing reaction on the processed sample. Alternatively, isothermal amplification reactions can be performed in the fission traps and then amplification products can be removed from the fission traps as above, for further processing in a next-generation (e.g. massively multiplex) sequencing workflow.

Further Considerations and Embodiments

Illustrative embodiments of the present teachings alleviate the need for oil as the second phase immiscible fluid in passive droplet coalescence and fission of such coalesced droplets, thus mitigating possible contamination from the oil itself, as well as reducing the complexity, time, and resources needed during passive droplet coalescence and fission. Illustrative embodiments of fluidic components, circuits and devices provided herein, are capable of merging two picoliter and/or nanoliter scale droplets without the use of external electrical, magnetic, or acoustic-driven forces, in a controlled and contaminant free environment. Furthermore, passive fluidic valves which are included in illustrative embodiments, reduce the complexity of introducing an external valve for proper control and manipulation of droplets.

In illustrative aspects, provided herein is a fluidic circuit, or a fluidic component or a fluidic device comprising the same, or a method of using the fluidic circuit, fluidic component, or fluidic device, that is effective for manipulating droplets (e.g. loading, merging, mixing, and/or splitting of droplets, and various combinations thereof). In illustrative embodiments, a fluidic component, a fluidic circuit, or a fluidic device comprising the same or a method of using the same, is effective and/or adapted for fusing a portion of a first liquid sample and a portion of a second liquid sample into a coalescent sample. Furthermore, in certain embodiments, a fluidic circuit, a fluidic component, fluidic device, or a method of using the same is effective and/or adapted for mixing the coalescent sample and/or effective and/or adapted for separating the coalescent sample into a plurality of sub-aliquots.

Accordingly with respect to embodiments that include a coalescing and a sub-aliquoting function, such components, circuits, and devices can be referred to as a droplet coalescence and fission component, circuit, or device, respectively. Such a fluidic component, fluidic circuit, or fluidic device provided herein, is typically effective for performing the fusing and the separating (typically sub-aliquoting) without the use of an immiscible phase (e.g. an immiscible phase that includes an oil). FIGS. 1-6 illustrate a non-limiting example of such a fluidic component and fluidic circuit. FIGS. 6-7 illustrate a non-limiting example of such a fluidic device. The specific structures, as well as the disclosed exemplary dimensions and associated volumes for those structures, for any of the elements illustrated in FIGS. 1-7, can individually be combined with any of the more general teachings for other structures of components, circuits, and devices provided in the illustrative embodiments and aspects provided herein in paragraphs that do not explicitly refer to any of the figures, such as, but not limited to, those in the section immediately below.

In illustrative embodiments provided herein, the fluidic circuit, and fluidic component or fluidic device comprising the same, includes at least one and typically a plurality of valves that can be driven by hydrostatic pressure differences, such as those provided by standard laboratory liquid handling equipment, for example a standard laboratory micropipettor, which can be, for example, an electronic pipettor or a syringe pump. Accordingly, in illustrative embodiments, external force-driven methods, such as electric, magnetic, or acoustic methods, are not used to move droplets within the fluidic component, fluidic circuit, or fluidic device, and in illustrative embodiments of fluidic component, fluidic circuit and fluidic device embodiments herein, specialized structures for performing these types of force-driven methods are not included. Rather, hydrostatic pressure differences are used in illustrative embodiments. Furthermore, in illustrative embodiments, an external valve is not included in the fluidic component, fluidic circuit, or fluidic device.

Accordingly, one illustrative aspect herein provides a fluidic circuit (and a fluidic component and fluidic device comprising the same) including: a sample capture branch comprising at least two sample capture sections, wherein each sample capture section comprises a sample capture trap and optionally each sample capture trap is associated with a sample capture valve, a sample capture constriction channel, a sample filling bypass channel, and a first sample filling chamber; and a sample coalescence/flow control branch comprising a coalescence trap in flow communication with the sample capture trap of each of the at least two sample capture sections, optionally wherein the sample coalescence trap is associated with a flow control valve, a flow control valve constriction channel, a flow control bypass channel, and a flow control primary channel chamber.

In certain embodiments of the fluidic component, the fluidic circuit is configured such that a pressure differential can be applied to the sample capture branch by applying a pressure to the flow control primary channel chamber. In certain embodiments, the sample capture branch is configured (or adapted) such that when a pressure differential is applied at the sample capture trap and the sample capture valve and associated sample capture constriction channel, at least 80%, 90%, 95%, 96%, 97%, 98%, 99%, or 99.9% of the fluid flows out, and/or is forced out and/or pushed out of the sample capture trap, and in certain illustrative embodiments less than 10%, 5%, 1%, or 0.1% of the fluid flows out, and/or is forced out and/or pushed out of the sample capture valve. In certain embodiments, there are no additional traps in a flow path between the sample capture trap and the sample coalescence trap. In certain embodiments, the fluidic circuit is configured such that hydrostatic pressure differences can be applied at any of one or more traps and associated constriction channels and valves in the fluidic channel, such that fluid is forced out of the trap upon application of the hydrostatic pressure difference. In certain embodiments, the fluidic circuit is configured such that droplet coalescence (i.e. droplet merging) efficiency is at least 90%, 95%, 98%, 99%, 99.5%, 99.9%, or 100% or between 90% and 100%, between 95% and 100%, between 95% and 99%, between 98% and 99% or between 99% and 100%.

In certain embodiments of the fluidic component, the fluidic circuit further comprises a sample sub-aliquoting branch in flow communication with the sample coalescence trap, wherein the sample sub-aliquoting branch comprises at least two fission trap sections, wherein each fission trap section comprises a sample fission trap. In illustrative embodiments, each sample fission trap is associated with a sample fission trap constriction channel, and in further embodiments, a sample fission trap outlet chamber. In illustrative embodiments, the sample sub-aliquoting branch further comprises a sample sub-aliquoting chamber. In certain embodiments, the fluidic circuit is configured such that sub-aliquoting (i.e. splitting) efficiency is at least 90%, 95%, 96%, 97%, or 98%, or between 90% and 98%, 95% and 98%, or 96% and 98%.

In certain embodiments of the fluidic component, the fluidic circuit further comprises a sample mixing channel in flow communication with the sample coalescence branch and the sample sub-aliquoting branch. In illustrative embodiments, the sample mixing channel has at least two complete serpentine coils, such as for example, between two and twelve serpentine coils. In certain embodiments, the fluidic circuit is configured such that splitting efficiency is 90% or 91% or is at least 75%, 80%, 85%, 90%, or 91%, or is between 80% and 90%, 80% and 91%, 85% and 90%, 90% and 91%.

An illustrative embodiment of a fluidic device herein includes the fluidic circuit aspect immediately above, wherein the fluidic device further comprises one or more ports in flow communication with one or more of the chambers of the fluidic channel. In an exemplary embodiment, the fluidic device comprises a plurality of ports, each of which is in flow communication with one of the chambers in the fluidic circuit.

In further illustrative embodiments, a fluidic circuit, and a fluidic component and fluidic device comprising the same, which are variations of, and can be combined in any individual element or combination of elements with other aspects herein, including for example the aspect and embodiments in the section immediately above, includes a first sample filling chamber of each of a first and second sample capture section, for receiving a first and second liquid sample, respectively. Typically, in fluidic devices herein, such sample filling chambers are filled through ports. The sample filling chambers are in flow communication with an inlet of a series of fluidic traps, each fluidic trap associated with, and in flow communication with an inlet of a constriction channel (which can also be referred to as a capillary constriction channel and typically has a diameter that is less than ½ the diameter of the trap to which it is connected, and which in certain illustrative embodiments is hydrophobic), a bypass channel, a fluidic valve, and a chamber. The structure of a trap and associated constriction channel and valve are such that when the trap and associated valve are filled with a fluid, the resistance of the trap is much smaller than the combined resistance of an associated valve and associated constriction channel. Thus, when a pressure differential is applied at a trap and associated valve and constriction channel, the fluid is pulled out of the trap but not the valve (and typically into the next trap of the fluidic component or circuit that has an associated chamber through which a lower pressure differential is applied). In certain embodiments, different chambers are opened and closed during operation of the fluidic component, fluidic circuit, or fluidic device to allow pressure differentials to be created at different traps and valves to force movement of droplets. An outlet of each of the sample filling chambers is in adjacent flow communication with an inlet of a sample capture trap, and an outlet of each of the sample capture traps is in adjacent flow communication with a same inlet of a same sample coalescence trap. There are no additional traps located in a fluidic path between traps said to be in "adjacent flow communication." In illustrative embodiments, a convergent channel connects the sample capture trap and the sample coalescence trap. In further illustrative embodiments, the convergent channel has a serpentine configuration. In certain illustrative embodiments, there is a sample convergent inlet chamber, such as that illustrated in the figures herein, between the convergent channel and the sample coalescence trap. The convergent channel in illustrative embodiments, has the configuration shown in the figures herein.

In certain illustrative embodiments, the sample coalescence trap, as illustrated in the figures herein, has an associated flow control valve, flow control valve constriction channel, flow control primary channel chamber and flow control bypass channel. In certain illustrative embodiments, fluidic component, fluidic circuit, and fluidic device comprising the same, further includes at least two fission trap sections each including a sample fission trap, each of which are in flow communication to the sample coalescence trap at an outlet of the sample coalescence trap typically through a sample sub-aliquoting channel. The sub-aliquoting channel typically includes a sample sub-aliquoting chamber at the end of the sub-aliquoting channel opposite the end closest to the sample coalescence trap. The sample fission traps each typically have associated sample fission trap constriction channel, a sample fission trap outlet, and a sample fission trap chamber. However, the fission traps do not typically include an associated valve.

In certain illustrative embodiments, fluidic circuit, or the fluidic component, or fluidic device comprising the same, further includes a mixing channel that is in flow communication, and typically adjacent flow communication with both an outlet of the sample coalescence trap through an inlet of the mixing channel, and an inlet of the sample fission traps through on an outlet end of the mixing channel. The mixing channel includes a sample mixing section that is typically configured other than a straight channel, such that it creates turbulence and therefore mixing of liquids that pass through it. In illustrative embodiments the sample mixing section has a serpentine configuration, and for example can include at least 2 complete serpentine coils.

In certain illustrative embodiments, the fluidic circuit is configured such that coalescence, mixing, and/or sub-aliquoting can be performed within 5 seconds. In some embodiments, the fluidic circuit is configured such that mixing can be performed within 5, 4, 3 or 2 seconds. In some embodiments, the fluidic circuit is configured such that sub-aliquoting (i.e. splitting) can occur within 5, 4, 3, 2, or 1 second.

In another aspect, provided herein is a fluidic component comprising a fluidic circuit comprising:

a. a sample capture branch comprising at least two sample capture sections, wherein each sample capture section comprises a sample capture trap; and b. a sample coalescence branch comprising i. a coalescence trap in flow communication with the sample capture trap of each of the at least two sample capture sections;

ii. at least two sample channels, optionally sample convergent channels, in fluid communication with each of the sample capture traps;

iii. a sample convergent inlet chamber in flow communication with each of the at least two sample channels; and iv. a sample coalescence trap, wherein said convergent inlet chamber converges in width from a convergent inlet chamber inlet to an outlet constriction channel in fluid communication with the sample coalescence trap.

In some embodiments for many aspects provided herein that include a fluidic circuit, the fluidic circuit further comprises a sample sub-aliquoting branch in flow communication with the sample coalescence trap, optionally wherein the sample sub-aliquoting branch comprises at least two fission trap sections, optionally wherein each fission trap section comprises a sample fission trap associated with a sample fission trap constriction channel, and a sample fission trap outlet chamber.

In some embodiments for many aspects provided herein that include a fluidic circuit, the fluidic circuit further comprises a sample mixing channel in flow communication with the sample coalescence branch and the sample sub-aliquoting branch.

In some embodiments for many aspects provided herein that include a fluidic circuit, the sample mixing channel has at least two complete serpentine coils, or for example between two and ten serpentine coils. In some embodiments for many aspects provided herein that include a fluidic circuit, the sample sub-aliquoting branch further comprises a sample sub-aliquoting chamber.

In some embodiments for many aspects provided herein that include one or more sample channels as part of a sample coalescence branch, the sample channels are sample convergent channels optionally including between 2 and 6 bends, loops, or turns, and in illustrative embodiments, the sample coalescence branch provides synchronized, nearly simultaneous, and optionally simultaneous transfer of each sample in a sample capture trap to the sample coalescence trap.

In some embodiments for many aspects provided herein that include a sample coalescence branch, the sample coalescence trap has a funnel shaped inlet end connected to the sample convergent inlet chamber through an optional outlet constriction channel of the sample convergent inlet chamber. In illustrative embodiments, the narrowest end of the funnel shaped inlet end is directly connected to the outlet constriction channel.

In certain illustrative embodiments herein, a fluidic circuit, or a fluidic component and/or a fluidic device comprising the same has most channel width dimensions in the micrometer or smaller scale and thus is considered a microfluidic circuit, microfluidic component, or microfluidic device. In certain illustrative embodiments herein, a fluidic circuit, or a fluidic component and/or a fluidic device comprising the same has all channel width dimensions in the micrometer or smaller scale.

In some embodiments, a fluidic device is provided herein, that comprises an array of fluidic components.

In another aspect, provided herein is a method for sample processing in a fluidic circuit comprising:

a. loading a first sample capture trap and a first sample capture valve with a first fluidic sample and a second fluidic sample capture trap and a second sample capture valve with a second fluidic sample, wherein the first sample capture trap and the second sample capture trap are in flow communication with a sample coalescence trap;

b. drawing the first fluidic sample and the second fluidic sample into the sample coalescence trap, forming a combined sample thereby; and c. drawing the combined fluidic sample into at least two fission traps, thereby sub-aliquoting the combined sample into at least two fission trap samples.

In some embodiments of any method aspect provided herein, after drawing the first fluidic sample and the second fluidic sample into the sample coalescence trap, the combined fluidic sample is drawn through a mixing channel. In illustrative embodiments, the combined fluidic sample is a droplet.

In some embodiments of any method aspect provided herein, the sample coalescence trap is configured to have a volume with a capacity for a defined combined sample volume for each sample capture trap. In some embodiments of any method aspect provided herein, for each of the at least two fission traps, the fission trap has a measurable geometry providing a defined fission trap sample volume.

In some embodiments of any method aspect provided herein, the first fluidic sample and the second fluidic sample are drawn into the sample coalescence trap to form a coalesced droplet by applying a pressure at a flow control primary channel chamber in flow communication with the sample coalescence trap. For example, the pressure can be applied using a standard laboratory liquid handling device such as a pipette or a syringe pump. In some embodiments of any method aspect provided herein, a decreased pressure of between 1 torr to about 40 torr is applied to the flow control primary channel chamber.

Unless otherwise indicated, the terms and phrases used herein are to be understood as the same would be understood by one of ordinary skill in the art. For instance, terms and phrases used herein can be used consistent with the definition provided by a standard dictionary such as, for example, the Tenth Edition of Merriam Webster's Collegiate Dictionary (1997). The terms "about", "approximately", and the like, when preceding a list of numerical values or range, refer to each individual value in the list or range independently as if each individual value in the list or range was immediately preceded by that term. The values to which the same refer are exactly, close to, or similar thereto (e.g., within about one to about 10 percent of one another). Ranges can be expressed herein as from about one particular value, and/or to about another particular value. When such a range is expressed, another aspect includes from the one particular value and/or to the other particular value. Similarly, when values are expressed as approximations, by use of the antecedent about or approximately, it will be understood that the particular value forms another aspect. It will be further understood that the endpoints of each of the ranges are significant both in relation to the other endpoint, and independently of the other endpoint. Ranges (e.g., 90-100%) are meant to include the range per se as well as each independent value within the range as if each value was individually listed. All references cited within this disclosure are hereby incorporated by reference into this application in their entirety.

Certain embodiments are further disclosed in the following examples. These embodiments are provided as examples only and are not intended to limit the scope of the claims in any way.

EXAMPLES

Example 1. Illustrative Prototype Fluidic Device

Prototype microfluidic channels and devices were made and tested. A prototype fluidic device according to FIG. 6 was made using soft lithography techniques. SU-8 2100 photoresist was spin coated on a silicon wafer at 500 RPMs for 10 sec and 1750 RPMs for 30 sec. Then it was baked on a hot plate for seven minutes at 65 degrees Celsius and an additional 37 minutes at 95 degrees Celsius. Then, using a photomask, the wafer along with the photomask were exposed to UV Light for 1 minute. After exposure it was again baked at 65 degrees Celsius for 5 minutes and an additional 15 minutes at 95 degrees Celsius. Next, it was taken off the hot plate and allowed to cool for about 5 minutes and then put into a glass dish with SU-8 developer and swirled by a Belly Dancer shaker for 15 minutes. The old Developer was removed and replaced, and the same process was repeated for 15 min. The fully developed wafer was cleaned with Isopropanol and dried with forced air until all developer and isopropanol were removed. The fully developed and dry design was placed inside a desiccator and silanized to functionalize the surface for 2 hours. Finally the design had PDMS poured on to it at a mixture of 10:1 and baked at 75 degrees Celsius for 2 hours. The PDMS mold was then cut out and the holes are punched for the inlet/outlet ports and the device was fixed to a glass slide for testing.

Droplet fusion capability of the prototype fluidic device was optimized using solutions of food dyes in distilled water to ensure effective merging of the trapped contents. To determine merging ability one primary trap was filled with fluorescein isothiocyanate (FITC) and the other with PBS. The intensity was then measured of the two primary traps to use as a standard. Therefore, the first FITC trap was normalized to be 100% and then because there was no signal in the trap with PBS, it was zero. Once the two drops were merged, the intensity of the coalescence trap was measured. This was tested on 16 identical prototype fluidic devices made as indicated immediately above in the Example.

To measure mixing, the measured intensity of the coalescent droplet was compared to the intensity of the sub-aliquoted droplets. This was done on the same 16 prototype fluidic devices. Splitting was measured in volume ratio of the two tertiary traps. Finally, washing ability of the sub-aliquoting branch was analyzed by measuring the FITC of the sample fission (i.e. tertiary) traps after sub-aliquoting and then measuring the FITC directly after the washing was performed. The timing of various steps was measured using a stop watch.

Based on testing the ability of various configurations of microfluidic channels for fusion capability, mixing, and droplet splitting, separating, or sub-aliquoting, a prototype microfluidic device with the features shown in FIG. 6 and FIG. 7 was designed and made as provided above in this Example, with dimensions within the ranges provided in the Detailed Description above. The sample capture sections were formed at a height of approximately 180 microns, the sample trap was approximately 520 microns wide and about 1 mm long, the sample capture valve was about 520 microns wide by about 520 microns long. The bypass channel had a width of about 520 microns and a length of about 6.25 mm, and the filling channels had a width of about 400 micron and a length of about 2.25 mm. The filling chambers 23, and 33 were 1 mm diameter. The mixing channel and other structures had the structure shown in FIG. 1 within the dimensions provided in the Detailed Description section for illustrative embodiments.

The prototype fluidic device was tested and the performance reported in Table 1 was obtained. With respect to droplet fusion, a drop with FITC was pulled into a first sample capture trap of a first sample capture section and a drop of PBS was delivered into a first sample capture trap of a second sample capture section using the method provided in FIG. 8A and FIG. 8B. The FITC was given a normalized intensity of 100% and the PBS had an intensity of 0%. The PBS and FITC drops in the sample capture traps were fused into a coalescence trap using methods provided herein (FIGS. 9A and 9B), and yielded a measured value of 50% of the intensity of the original FITC droplet. Thus, the device and method for using it to fuse droplets was highly effective with an efficiency of fusing droplets at or near 100%.

To measure mixing efficiency, the coalescent FITC/PBS droplet was delivered through a mixing channel using methods provided herein (FIG. 11A). The measured intensity of the sub-aliquoted droplets was 91% compared to the intensity of the coalescent droplet. Therefore, effective mixing was occurring with the device. However, some loss of intensity was observed in the excess fluid aspirated out of sample sub-aliquoting channel 92. Not to be limited by theory, it is believed that this might be due to lack of diffusion time inside the mixing channel. Therefore, more serpentine coils likely would make this process have even a higher percent efficacy.

The mixed droplet was sub-aliquoted (i.e. split) using the methods provided in FIG. 11B. Splitting was measured in volume ratio of the two sub-aliquot traps. The volume of one sample fission trap was 98% that of the other. That is, one sample fission trap volume was 35 nl and the volume of the other sample fission trap was 34.3 nl.

Finally, washing performed according to FIG. 12A and FIG. 12B and washing efficiency was analyzed by measuring the FITC of the sample fission traps after sub-aliquoting and then measuring the FITC directly after the washing was performed. After a first wash, the signal from the samples in the washed fission traps, which had a starting intensity of 100, had an intensity of 8. This was retested after washing a second time and yielded a value of 0 (100% efficiency of washing).

TABLE 1

Performance of prototype microfluidic device

| Process | % Efficacy | Time taken per process |
|---|---|---|
| Merging | 100% | 5 s |
| Mixing | 91% | 2 s |
| Splitting (nL) | 98% | 1 s |
| First Wash | 92% | 5 s |
| Second Wash | 100% | 5 s |

Example 2. Illustrative ELISA Assay Using Prototype Fluidic Device

A fluidic device according to device 200 of FIG. 6 was made and tested in an ELISA assay. This experimental write-up refers to FIG. 13, which depicts an illustrative assay work flow 300 for an exemplary ELISA analysis that can be performed according to the present teachings. In an illustrative ELISA analysis that was performed, reagents from a BioLegend ELISA MAX™ Mouse IL-6 kit were used and prepared as given in the instructions accompanying the kit, except the mouse IL-6 antigen standard was prepared at 0.5 μg/ml (microgram/ml) and 1 μg/ml (microgram/ml) of mouse IL-6 antigen. Work flow 300 can utilize an illustrative device of the present teachings, such as fluidic device 200 of FIG. 6.

Figure 13:
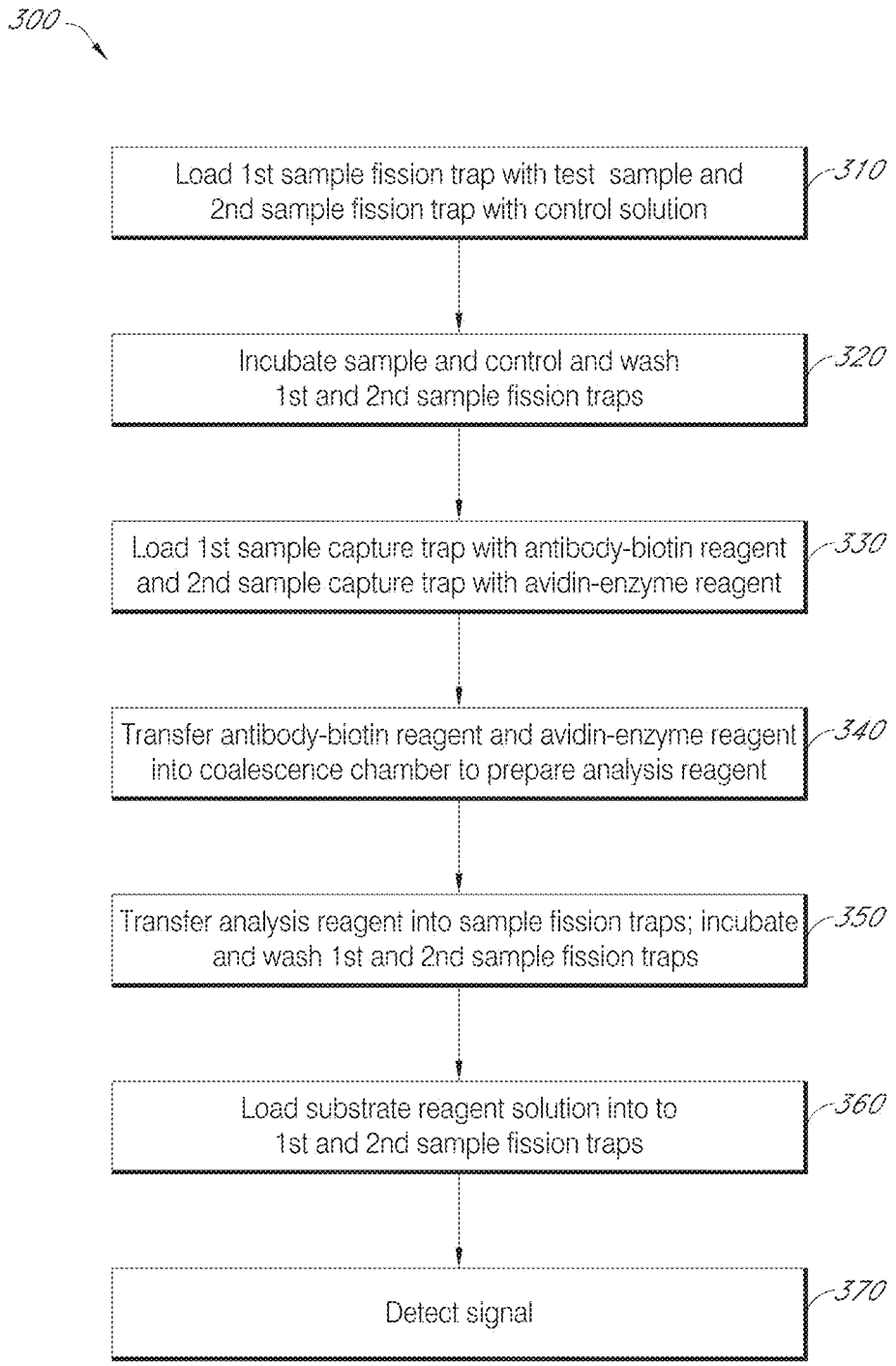
FIG. 13 depicts an assay work flow diagram for an exemplary analysis that can be performed according to the present teachings.

For step 310 of assay work flow 300, as depicted in FIG. 13, using the illustrative method for loading or washing each fission trap as previously described herein for FIG. 12A and FIG. 12B, samples of the 0.5 μg/ml mouse IL-6 antigen standard were loaded in a first fission trap, such as first fission trap section 70 of FIG. 5, for each of a fluidic circuit, such as to each of fluidic circuit 100A1 through fluidic circuit 100F1 of FIG. 6. Similarly, samples of the 1.0 μg/ml mouse IL-6 antigen standard were loaded to a first fission trap, such as first fission trap section 70 of FIG. 5, for each of a fluidic circuit, such as to each of fluidic circuit 100A2 through fluidic circuit 100F2 of FIG. 6. To each of a second fission trap, such as second fission trap section 80 of FIG. 5, for each fluidic circuit used in the assay, phosphate buffer saline (PBS) was loaded as a control. As depicted in FIG. 13 for step 320 of assay work flow 300, the device was incubated at room temperature for 2 hours, followed by an incubation at 37° C. for 20 minutes. After incubation of the samples was complete, the first and the second fission traps were washed twice with 5 μl (microliter) of PBS with Tween-20 using the illustrative method for loading or washing each fission trap as previously described herein for FIG. 12A and FIG. 12B. After step 310 and step 320 of assay work flow 300 have been completed, each first fission trap has been coated using the target solution of mouse IL-6 antigen standard, and is proximal to a second fission trap prepared as a control using PBS.

As depicted in FIG. 13 at step 330 of assay work flow 300, using the illustrative method for sample loading as previously described herein for FIG. 8A and FIG. 8B, each sample capture trap of the first sample trap section, such as sample capture trap 26 of first sample capture section 20 of FIG. 1, for all fluidic circuits used in the assay was loaded with a solution of mouse IL-6 detection antibody reagent diluted by 1:200 with PBS. Similarly, each sample capture trap of the second sample trap section, such as sample capture trap 36 of second sample capture (i.e. trap) section 30 of FIG. 1, for all fluidic circuits used in the assay was loaded with a solution Avidin-HRP reagent diluted by 1:1000 with PBS. As depicted in FIG. 13 for step 340 of assay work flow 300, each reagent in each sample capture trap of each sample capture section for each fluidic circuit used in the assay was transferred to a respective sample coalescence trap of each fluidic circuit used in the assay, such as sample coalescence trap 44 of FIG. 1 using the illustrative method for forming a coalescent sample as previously described herein for FIG. 9A and FIG. 9B. The device was incubated at room temperature for 20 minutes to allow the formation of an antibody-HRP conjugate reagent in the sample coalescent trap of each fluidic circuit used in the assay As depicted in FIG. 13 for step 350 of assay work flow 300, the antibody-HRP conjugate reagent was transferred to each fission trap of each fluidic circuit used in the assay using the illustrative method for transferring a coalescent sample in a sample coalescence trap through a mixing channel and into a sub-aliquoting branch as previously described herein for FIG. 11A and FIG. 11B. The device was incubated at room temperature for 20 minutes. After incubation of the samples was complete, the sample sub-aliquoting branch of each fluidic circuit used in the assay was washed twice with 5 μl (microliter) of PBS using the illustrative method for loading and washing a sub-aliquoting branch as previously described herein for FIG. 12A and FIG. 12B. After step 330 through step 350 of assay work flow 300 have been completed, each test sample and each control in each fission trap of each fluidic circuit used in the assay has been reacted with the antibody-enzyme conjugate reagent prepared in step 340.

For step 350 of assay work flow 300, as depicted in FIG. 13, using the illustrative method for loading and washing a sub-aliquoting branch as previously described herein for FIG. 12A and FIG. 12B, each fission trap of each fluidic circuit used in the assay was loaded with 3,3',5,5'-Tetramethylbenzidine (TMB) substrate solution as provided in the BioLegend ELISA MAX™ Mouse IL-6 kit and the device was allowed to incubate for 2 minutes at room temperature. For step 360 of assay work flow 300, as depicted in FIG. 13, optical detection can be performed for each set of test and control fission traps, using, for example, a CCD camera. As expected, each test sample using the 0.5 μg/ml mouse IL-6 antigen standard showed less color intensity than each test sample using the 1.0 μg/ml mouse IL-6 antigen standard, while each control displayed no detectable color intensity.

While certain embodiments have been described in terms of illustrative embodiments, it is understood that variations and modifications will occur to those skilled in the art. Therefore, it is intended that the appended claims cover all such equivalent variations that come within the scope of the following claims.

What is claimed is:

1. A fluidic component comprising:

a fluidic circuit formed in a substrate comprising:

a sample capture branch comprising at least two sample capture sections, wherein each sample capture section comprises:

a sample capture trap with an outlet end in flow communication with an outlet end of a sample capture valve via a sample capture constriction channel, a sample filling bypass channel having a first end in flow communication with an inlet end of the sample capture trap and a second end in flow communication with an inlet end of the sample capture valve;

a first sample filling chamber in flow communication with the first end of the sample filing bypass channel via a first sample filling channel and a second sample filling chamber in flow communication with the second end of the bypass channel via a second sample filling channel, a sample coalescence branch in flow communication with the at least two sample capture sections of the sample capture branch, the sample coalescence branch comprising:

a sample convergent channel in flow communication with each sample capture trap of the at least two sample capture sections, wherein each sample convergent channel is in flow communication with a sample convergent inlet chamber;

a sample coalescence trap in flow communication with the sample convergent inlet chamber; and a flow control branch in flow communication with the sample coalescence branch, the flow control branch comprising:

a flow control bypass channel in flow communication with the sample coalescence trap and with a flow control primary channel, wherein the flow control primary channel is in flow communication with a flow control primary channel chamber; and a flow control valve in flow communication with the flow control primary channel and with a flow control valve constriction channel.

2. The fluidic component of claim 1, further comprising:

a sample sub-aliquoting branch in flow communication with the flow control branch, the sample sub-aliquoting branch comprising:

a sample sub-aliquoting channel in flow communication with at least two fission trap sections, wherein each fission trap section comprises:

a sample fission trap having an inlet end in flow communication with the sample sub-aliquoting channel and an outlet end in flow communication with a sample fission trap constriction channel, a sample fission trap outlet chamber in flow communication with the sample fission trap constriction channel through a sample fission trap outlet chamber constriction channel; and a sample sub-aliquoting chamber in flow communication with the sample sub-aliquoting channel.

3. The fluidic component of claim 2, further comprising a sample mixing channel in flow communication with the sample coalescence branch and the sample sub-aliquoting branch, the sample mixing channel comprising:

a first sample mixing channel section in flow communication with the sample coalescence trap and with the flow control valve constriction channel, a second sample mixing channel section having at least two complete serpentine coils, wherein the second sample mixing channel section has a first end in flow communication with a second end of the first sample mixing channel section; and a third sample mixing channel section having a first end in flow communication with a second end of the second sample mixing channel section and a second end in flow communication with the sample sub-aliquoting channel.

4. The fluidic component of claim 2, wherein each of the at least two fission trap sections further comprise a fission trap chamber in flow communication with the sample sub-aliquoting channel and with the inlet end of the sample fission trap through a fission trap chamber channel.

5. The fluidic component of claim 2, further comprising a flow control secondary channel in flow communication with the flow control primary channel, wherein the flow control secondary channel is in flow communication with a flow control secondary channel chamber.

6. The fluidic component claim 1, wherein each sample capture constriction channel of the at least two sample capture sections is hydrophobic.

7. The fluidic component of claim 1, wherein for each of the at least two sample capture sections, the sample capture trap has a measurable geometry providing a defined sample volume and the sample capture valve has a measurable geometry providing a defined valve volume.

8. The fluidic component of claim 7, wherein for each of the at least two sample capture sections, the ratio of the sample volume of the sample capture trap to the valve volume of the sample capture valve is 2:1.

9. The fluidic component of claim 1, wherein the sample coalescence trap is configured to have a measurable geometry providing a defined volume with a capacity for each defined sample volume for each sample capture trap of the at least two sample capture sections.

10. The fluidic component of claim 2, wherein each sample fission trap has a measurable geometry providing a defined fractional volume of the sample coalescence trap volume.

11. A fluidic device comprising:

a substrate with a first surface and a second surface; said substrate having a fluidic circuit formed on the first surface; wherein the fluidic circuit comprises:

a sample capture branch comprising at least two sample capture sections, wherein each sample capture section comprises:

a sample capture trap in flow communication with a sample capture valve via a sample capture constriction channel; and a first and second sample filling port formed through the substrate from the second surface, wherein the first and second sample filling ports are in flow communication with the sample capture trap and the sample capture valve;

a sample coalescence branch in flow communication with the at least two sample capture sections of the sample capture branch, wherein the sample coalescence branch comprises a sample coalescence trap configured to have a volume with a capacity for each defined sample volume for each sample capture trap of the at least two sample capture sections;

a flow control branch in flow communication with the sample coalescence branch, wherein the flow control branch comprises:

a flow control port formed through the substrate from the second surface in flow communication with a flow control primary channel, wherein the flow control primary channel is in flow communication with the sample coalescence trap; and a flow control valve in flow communication with the flow control primary channel and with a flow control fluid valve constriction channel;

a sample sub-aliquoting branch in flow communication with the flow control branch, wherein the sample sub-aliquoting branch comprises:

a sample sub-aliquoting port formed through the substrate from the second surface in flow communication with a sample sub-aliquoting channel, wherein the sample sub-aliquoting channel is in flow communication with the flow control primary channel;

at least two fission traps, wherein each of the at least two fission traps are a defined fractional volume of the sample coalescence trap volume; and a cover formed over the first surface of the substrate.

12. The fluidic device of claim 11, wherein the fluidic device comprises an array of the fluidic circuits, and each the fluidic circuits further comprises a sample mixing channel in flow communication with the sample coalescence branch and the sample sub-aliquoting branch, the sample mixing channel comprising at least two complete serpentine coils.

13. A method for sample processing in the fluidic circuit of the fluidic component of claim 1, comprising:

loading a first sample capture trap and a first sample capture valve each of a first of the at least two sample capture sections, with a first fluidic sample and a second fluidic sample capture trap and a second sample capture valve each of a second of the at least two sample capture sections, with a second fluidic sample, wherein the first sample capture trap and the second sample capture trap are in flow communication with the sample coalescence trap;

drawing the first fluidic sample and the second fluidic sample into the sample coalescence trap, forming a combined sample thereby; and drawing the combined fluidic sample into at least two fission traps, thereby sub-aliquoting the combined sample into at least two fission trap samples.

14. The method of claim 13, further comprising, after drawing the first fluidic sample and the second fluidic sample into the sample coalescence trap, drawing the combined fluidic sample through a mixing channel, wherein the combined fluidic sample is a droplet.

15. The method of claim 13, wherein the sample coalescence trap is configured to have a volume with a capacity for a defined combined sample volume for each sample capture trap.

16. The method of claim 13, wherein for each of the at least two fission traps, the fission trap has a measurable geometry providing a defined fission trap sample volume.

17. The method of claim 13, wherein the first fluidic sample and the second fluidic sample are drawn into the sample coalescence trap to form a coalesced droplet, by applying a pressure at the flow control primary channel chamber in flow communication with the sample coalescence trap.

18. The method of claim 17, wherein the pressure is applied using a standard laboratory liquid handling device.

19. A fluidic component comprising a fluidic circuit comprising:

a sample capture branch comprising at least two sample capture sections, wherein each sample capture section comprises a sample capture trap and each sample capture trap is associated with a sample capture valve, a sample capture constriction channel, a sample filling bypass channel, and a first sample filling chamber; and a sample coalescence/flow control branch comprising a sample coalescence trap in flow communication with the sample capture trap of each of the at least two sample capture sections, wherein the sample coalescence trap is associated with a flow control valve, a flow control valve constriction channel, a flow control bypass channel, and a flow control primary channel chamber.

20. The fluidic component of claim 19, wherein the fluidic circuit is configured such that a pressure differential can be applied to the sample capture branch by applying a pressure to the flow control primary channel chamber.

* * * * *